US011851964B2

(12) United States Patent
Purkis

(10) Patent No.: US 11,851,964 B2
(45) Date of Patent: Dec. 26, 2023

(54) FIBRE SPOOLING APPARATUS

(71) Applicant: Well-Sense Technology Limited, Aberdeen (GB)

(72) Inventor: Daniel George Purkis, Dyce (GB)

(73) Assignee: WELL-SENSE TECHNOLOGY LIMITED WELLHEADS CRESCENT, WELLHEADS INDUSTRIAL ESTATE, Aberdeen (GB)

( * ) Notice: Subject to any disclaimer, the term of this patent is extended or adjusted under 35 U.S.C. 154(b) by 1 day.

(21) Appl. No.: 17/636,952

(22) PCT Filed: Jul. 10, 2020

(86) PCT No.: PCT/EP2020/069672
§ 371 (c)(1),
(2) Date: Feb. 21, 2022

(87) PCT Pub. No.: WO2021/043479
PCT Pub. Date: Mar. 11, 2021

(65) Prior Publication Data

US 2022/0381100 A1 Dec. 1, 2022

(30) Foreign Application Priority Data

Sep. 2, 2019 (GB) ..... 1912600

(51) Int. Cl.
*E21B 23/14* (2006.01)

(52) U.S. Cl.
CPC ..... *E21B 23/14* (2013.01)

(58) Field of Classification Search
CPC ..... E21B 23/14; E21B 23/08; E21B 33/072
See application file for complete search history.

(56) References Cited

U.S. PATENT DOCUMENTS

2014/0196893 A1* 7/2014 Vigneaux ..... E21B 23/08 166/305.1
2016/0237750 A1* 8/2016 Purohit ..... E21B 23/04
(Continued)

FOREIGN PATENT DOCUMENTS

WO WO-2015/088558 A1 6/2015
WO WO-2017/009671 A1 1/2017
WO WO-2019/016538 A1 1/2019

OTHER PUBLICATIONS

International Preliminary Report on Patentability for PCT/EP2020/069672 dated Mar. 17, 2022.
(Continued)

*Primary Examiner* — Christopher J Sebesta
(74) *Attorney, Agent, or Firm* — Harness, Dickey & Pierce, P.L.C.

(57) ABSTRACT

An apparatus and method for deploying an elongate medium in a bore is described. The apparatus includes a housing defining an internal spool cavity, and the housing is configured to be deployed in the bore. A spool of elongate medium is mounted within the spool cavity. The housing defines an outlet to permit the elongate medium to be deployed from the spool cavity, and an inlet to permit bore fluid to enter the housing during deployment of the elongate medium from the spool cavity. In use, the housing includes an isolating fluid to isolate the elongate medium from the bore fluid entering the housing. Also described is a kit for deploying elongate medium in a bore and a method of preparing an apparatus for deployment of an elongate medium in a bore.

16 Claims, 9 Drawing Sheets

(56) References Cited

U.S. PATENT DOCUMENTS

2020/0325728 A1* 10/2020 Biddick ..... E21B 4/02
2020/0340791 A1* 10/2020 Bouldin ..... G01V 1/42

OTHER PUBLICATIONS

International Search Report PCT/ISA/210 and Written Opinion PCT/ISA/237 for International Application No. PCT/EP2020/069672 dated Jul. 10, 2020.
GBER for Great Britain Application No. 1912600.2 dated Jun. 3, 2020.

* cited by examiner 21
110
116
111
120
113
118
152
117
141
115
150

118
141
116
114
143
142
119
111
120
$D_2$
120
113

118
116
114
141
143
117
119
142
119
111
$D_2$
113

116
118
141
143
142
111
113

21
110
116
146
111
117
115
141

118
110
116
146
116
111
120
160
113
144
148
147
141
142
119

158
116
118
117
141
110
114
117
119
147
119
144
148
147
146
143
113
142

142
116
118
141
143
110
160
147
111
113

FIBRE SPOOLING APPARATUS

This application is a national phase under 35 U.S.C. § 371 of PCT International Application No. PCT/EP2020/069672 which has an International filing date of Jul. 10, 2020, which claims priority to GB Application No. 1912600.2, filed Sep. 2, 2019, the entire contents of each of which are hereby incorporated by reference.

FIELD

The present disclosure relates to apparatus and methods for deploying an elongate medium in a bore, and additional apparatus and methods for preparing an apparatus for the deployment of an elongate medium.

BACKGROUND

Optical fibres are conventionally deployed in wellbores to facilitate sensing operations, such as distributed sensing operations including distributed temperature sensing (DTS), distributed pressure sensing (DPS) and distributed acoustic sensing (DAS). Optical fibres may also be used for data communication to/from a wellbore, for example, to control downhole operations.

The present inventor has proposed, for example in WO 2017/009671, to deploy an optical fibre from a tool or device as the tool or device traverses a wellbore, and then use the deployed optical fibre in sensing and/or communication operations. Such an arrangement may permit the optical fibre to be deployed as required, and may avoid costs and reliability concerns with permanent installations.

Optical fibres can be sensitive to damage in the downhole environment, for example, from exposure to bore fluid within the wellbore. Some bore fluids can contain debris or solid particles, which can be detrimental to the unspooling of the optical fibre downhole. In particular, drilling mud that has been weighted with ground barium powder has been shown to cause damage to optical fibres. Therefore, the environment in which the optical fibre is stored prior to and during deployment can be important.

SUMMARY

An aspect of the present disclosure relates to an apparatus for deploying an elongate medium in a bore. The apparatus may comprise a housing defining an internal spool cavity and configured to be deployed in the bore. The apparatus may comprise a spool of elongate medium mounted within the spool cavity. The housing may define an outlet to permit the elongate medium to be deployed from the spool cavity. The housing may define an inlet to permit bore fluid to enter the housing during deployment of the elongate medium from the spool cavity. The apparatus may be configured such that, in use, the housing comprises an isolating fluid to isolate the elongate medium from the bore fluid entering the housing.

The apparatus may be configured so that the spool of elongate medium remains isolated from the bore fluid that has entered the cavity during the complete deployment of the elongate medium from the spool cavity. The apparatus may be configured such that, in use, the spool of elongate medium may be at least partially immersed in an isolating fluid to isolate the elongate medium from the bore fluid entering the housing. The isolating fluid may comprise any fluid, in particular, any liquid. The volume of bore fluid that enters the housing may correspond to the volume vacated by the deployed elongate medium.

The provision of an internal spool cavity wherein the spool of elongate medium can be at least partially immersed in an isolating fluid, in use, to isolate the elongate medium from the bore fluid entering the housing may protect the elongate medium from exposure to bore fluids, for example, as the elongate medium is deployed. This may prevent or minimise unwanted damage to the elongate medium, and/or prevent or minimise hindering of the deployment process.

The housing may be configured to be deployed in a bore. The housing may be configured to traverse the bore. As the housing traverses the bore, the elongate medium may be deployable from the internal spool cavity from the outlet.

As the elongate medium is deployed from the internal spool cavity, the free volume of the internal spool cavity may increase. The free volume may be the volume within the internal spool cavity that is not occupied by, for example, the spool of elongate medium and/or, in use, isolating fluid. Bore fluid may enter the housing during deployment of the elongate medium to occupy the free volume within the spool cavity. Therefore, the volume of bore fluid that enters the housing may correspond to the volume vacated by the deployed elongate medium and/or any isolating fluid that may also vacate the housing via the outlet.

The bore in which the elongate medium may be deployed may be a wellbore, such as an oil and/or gas wellbore. Such a bore may comprise only a liquid portion, or a liquid portion together with a gas portion, such as a gas cap.

The internal spool cavity may define a vacant space that is not occupied by the spool of elongate medium. In use, the vacant space may be at least partially filled with the isolating fluid. In some examples, the vacant space, in use, may be completely filled with isolating fluid. Alternatively, the vacant space, in use, may be partially filled with isolating fluid. In this instance, the remaining vacant space may be filled with a gas, such as air.

Such filling of the vacant space may be determined in accordance with the application in which the apparatus is used. For example, where the bore comprises only a liquid portion, the vacant space of the cavity, in use, may be completely filled with isolating fluid prior to deployment. Alternatively, the vacant space, in use, may be partially filled with isolating fluid and partially filled with gas. The vacant space may be dimensioned such that during deployment of the elongate medium, the elongate medium remains isolated from bore fluid that has entered the cavity.

Where the bore comprises a liquid portion and a gas portion, such as a gas cap, the elongate medium may be deployed through two different environments; initially the gas portion followed by the liquid portion. During deployment of the elongate medium through the gas portion of the wellbore, the apparatus may experience a significantly smaller drag force than when compared to traversing the liquid portion. As such, the velocity at which the apparatus traverses the gas portion may be substantially greater than that when in the fluid portion. Therefore, the rate of deployment of the elongate medium from the cavity may be substantially greater in the gas portion.

Without wishing to be bound by theory, the present inventor has discerned that such an increase in velocity of the apparatus, and thus an increase in the rate of deployment of the elongate medium, through the gas portion of the wellbore may have an adverse effect on the interaction between the unspooling elongate medium and an isolating fluid. For example, the increased rate of the unspooling of the elongate medium may impart a large drag force on the elongate medium which may result in breakage. The increased rate of unspooling may impart on an isolating fluid within the cavity an increased rotational velocity. Such an increase in rotational velocity of the isolating fluid may cause vortices to form, which may result in cavitation of the isolating fluid. Such a scenario may be detrimental to the deployment of the elongate medium, and may potentially cause breakage of the elongate medium.

Where the apparatus is deployed in a such wellbore having a liquid portion and gas portion, the vacant space, in use, may be partially filled with isolating fluid, and the remaining vacant space may be filled with a gas, such as air. The spool of elongate medium may be surrounded by the gas within the cavity during deployment of the elongate medium in the gas portion. Such an arrangement may reduce the likelihood of adverse interactions of the unspooling elongate medium with a liquid isolating medium in the cavity. This may provide for a smooth, reliable deployment of the elongate medium while minimising the risk of damage to the structural integrity of the elongate medium.

The apparatus may be configured to be filled with the isolating fluid at the site of deployment, or instead the apparatus may be configured to be filled offsite and delivered ready for deployment. Such onsite or offsite filling may be achieved by submerging the apparatus in a volume of isolating fluid. Alternatively, the apparatus may be configured to be filled with isolating fluid by inducing a flow of isolating fluid into the apparatus via the inlet and/or outlet of the apparatus, for example, by pumping, injecting, manually pouring etc. the isolating fluid into the apparatus.

The apparatus may be provided with a draining mechanism. The draining mechanism may be configured to drain the apparatus when it is completely full of isolating fluid. Such draining may be to the extent that the apparatus becomes partially filled with isolating fluid and partially filled with gas prior to deployment in the wellbore. The draining mechanism may comprise a valve connected to the apparatus. The valve may be located on a side face of the apparatus, and may be at any suitable position between the leading end of the apparatus and the trailing end of the apparatus. The valve may be configured to be opened by receiving a wireless activation signal. The valve may be configured to be opened manually. The provision of such a valve may provide for the apparatus to be partially filled with isolating fluid and partially filled with gas immediately before deployment, if so required by the application.

The apparatus may be configured so that the inlet is positioned to permit bore fluid to enter into the housing relative to the spool cavity such that, in use, an interface is established between the isolating fluid and the bore fluid entering the spool cavity. The interface may advance along or through the spool cavity as the elongate medium is deployed. The spool of elongate medium may be provided such that it is maintained in a non-contact relationship with the advancing interface. Configuring the apparatus as such may prevent contact between the spool of elongate medium and the bore fluid, thus avoiding or minimising the risk of damage to the elongate medium.

In use, the apparatus may define a leading end and a trailing end. Such leading and trailing ends may be defined with respect to a direction of deployment into a wellbore. The leading end may comprise the inlet, and the trailing end may comprise the outlet.

The housing may be configured to prevent bore fluid from entering the internal spool cavity above a certain flow rate. The flow rate may be determined in accordance with a rate of deployment of the elongate medium from the spool cavity. The flow rate may be determined in accordance with a rate of the volumetric increase of the vacant space in the spool cavity.

Where the internal spool cavity defines a vacant space, the vacant space may define a volume that is greater than or equal to the volume of elongate medium initially provided on the spool of elongate medium. This volume of vacant space may assist in keeping the elongate medium isolated from the bore fluid that enters the cavity.

As the spool of elongate medium is deployed, the volume of vacant space in the spool cavity may increase. The spool of elongate medium may be configured such that the rate of deployment of the elongate medium provides a volumetric increase of the vacant space, which may be equal to the rate of intake of bore fluid. Accordingly, the volume of bore fluid entering into the cavity may be the same as the increase in volume of vacant space resulting from the deployment of the elongate medium. A spool of elongate medium configured as such may also assist in keeping the elongate medium isolated from the bore fluid entering the cavity.

In some instances, a portion of the isolating fluid may be vacated from the cavity alongside the elongate medium as it is deployed, for example due to the boundary layer effect. In this respect, the volume of bore fluid entering the cavity may be equal to the volume within the housing that has been vacated by the deployed elongate medium and isolating fluid.

The vacant space defined by the internal spool cavity may be, in use, partially filled with isolating fluid and partially filled with a gas. Alternatively, the vacant space, may be, in use, completely full of isolating fluid.

The spool of elongate medium may be configured to be deployed such that the volume occupied by the spool of elongate medium decreases from one end of the spool cavity to the other. This may allow for the spool of elongate medium to be maintained in the non-contact relationship with the advancing interface. For example, the depletion in the volume of the spool of elongate medium may be in advance of the advancing interface.

The internal spool cavity may comprise a first chamber and a second chamber. The spool of elongate medium may be mounted within the first chamber. The first and second chambers may be configured to be in fluid communication to permit, in use, isolating fluid provided in the second chamber to be received within the first chamber to fill the volume within the first chamber that has been vacated by the deployed elongate medium.

The volume of the second chamber may be at least equal to the volume vacated by the elongate medium in the first chamber when the elongate medium is fully deployed. Sizing the second chamber accordingly may allow for the provision of a volume of isolating fluid that may fill the first chamber as the elongate medium is depleted, preventing or minimising the likelihood of bore fluid entering the first chamber and contacting the elongate medium.

The apparatus may be configured such that the bore fluid is permitted to enter the second chamber via the inlet. Accordingly, the bore fluid may occupy the volume of the second chamber vacated by the isolating fluid that has moved to the first chamber. Such an arrangement may reduce the risk of exposing the spool of elongate medium to bore fluids.

The internal spool cavity may be provided with a partition between the first and second chambers. The partition may be configured to provide a flow path from the second chamber to the first chamber. For example, the partition may comprise a plate having at least one hole for fluid to pass through. The partition may be configured for one-way flow, for example, the partition may comprise a one-way valve. This may ensure that fluid can only flow from the second chamber into the first chamber, and not vice-versa.

The apparatus may further comprise a filter provided between the first and second chambers. Where a partition is provided, the filter may be positioned within the flow path of the partition.

The filter may be configured, for example, through selection of an appropriate material and/or pore size, to filter debris from the isolating fluid for example as the elongate medium is deployed. The filter may be configured, for example, through selection of an appropriate material and/or pore size, to filter debris from bore fluid. The filter may be configured to clean bore fluid to a suitable level of purity in the event that bore fluid comes into contact with the elongate medium, such that the risk of damage or compromise to the elongate medium is minimised. The filter may be configured for cleaning bore fluid to a suitable level of purity in the event that bore fluid passes from the second chamber to the first chamber. The filter may be configured to minimise resistance to flow through the filter, for example, the filter may comprise a cylindrical shape.

The apparatus, in use, may be filled with an isolating fluid such that the vacant space within the internal spool cavity is completely filled with the isolating fluid prior to deployment. Where the cavity comprises first and second chambers, the first and second chambers may be completely filled with the isolating fluid. As the elongate medium is deployed from the outlet, the free volume of the cavity will increase. This increase in free volume may be a result of the elongate medium being deployed and, in some instances, fluid loss from the cavity. For example, as the elongate medium is deployed, isolating fluid may also be pulled out through the outlet alongside the deployed elongate medium. At this stage, bore fluid may enter the housing to occupy this vacated volume.

The apparatus, in use, may be partially filled with an isolating fluid such that part of the vacant space within the internal spool cavity is filled with isolating fluid. The remaining space may be filled with a gas, such as air. Where the cavity comprises first and second chambers, the first chamber may be partially filled with gas and partially filled with isolating fluid, or completely full of gas, and the second chamber may be completely full of isolating fluid. Alternatively, the first chamber may be completely full of gas and the second chamber may be partially filled with gas and partially filled with isolating fluid.

Where the cavity comprises a first and second chamber, as the elongate medium is deployed from the outlet, a resulting pressure difference between the first and second chambers during the deployment process may allow for isolating fluid to be communicated from the second chamber to the first chamber, for example, to fill the vacated volume in the first chamber.

The spool of elongate medium may be at least partially immersed in the isolating fluid, and isolated from the bore fluid entering the housing during at least the early stages of deployment of the elongate.

In other examples, at the early stages of deployment the spool of elongate medium may not be partially immersed in isolating fluid, but instead a volume of isolating fluid may be provided in the housing between the spool of elongate medium and the inlet. The volume of isolating fluid may function to isolate the spool of elongate medium from bore fluid entering the housing via the inlet.

The housing may further comprise a fluid outlet. The fluid outlet may be the same as the outlet provided in the housing for the elongate medium. Alternatively, the fluid outlet may be provided in addition to the outlet for the elongate medium.

In some examples, the fluid outlet may be configured to allow the cavity to be filled with an isolating fluid prior to deployment in the bore. Where the chamber comprises first and second chambers, the fluid outlet may be configured to allow one or both chambers to be filled with the isolating fluid prior to deployment in the bore. Once the cavity has been filled, the fluid outlet may be configured to connect with a valve or capping device. The valve or capping device may be configured to permit the elongate medium to be deployed from the cavity while preventing bore fluid from entering the cavity via the outlet.

The fluid inlet may be configured to allow the cavity to be filled with an isolating fluid prior to deployment in the bore. Where the chamber comprises first and second chambers, the fluid inlet may be configured to allow one or both chambers to be filled with an isolating fluid prior to deployment in the bore. The fluid inlet may comprise a one-way valve configured to permit fluid flow into housing. The one-way valve may be configured to permit fluid flow into the cavity.

The fluid inlet and fluid outlet may be arranged such that there is a flow path through the apparatus. Where the cavity comprises a first and second chamber, the flow path through the apparatus may be, for example, from the second chamber to the first chamber, and not vice versa.

The provision of a fluid inlet and a fluid outlet may ensure that the apparatus is pressure compensated as the housing traverses the bore. The fluid outlet may be configured for one-way flow such that fluid from the housing, for example, a first fluid, may flow out of the outlet but fluid from the bore cannot flow into the housing via the outlet. To this effect, a one-way valve may be provided in the fluid outlet to allow the elongate medium to be deployed therethrough while preventing bore fluid from entering the cavity via the outlet. Fluid from the bore may enter the housing via the fluid inlet, whilst isolating fluid from the cavity exits the housing via the fluid outlet. The inflow of bore fluid into the housing may assist in driving the isolating fluid to occupy the volume within the housing which has been vacated as the elongate medium is deployed.

Where the cavity comprises a first and second chamber, the fluid outlet may be configured for one-way flow such that fluid from the first chamber may flow out of the outlet but fluid from the bore cannot flow into the first chamber via the outlet. Fluid from the bore may enter the second chamber via the fluid inlet, whilst fluid from the first chamber exits the first chamber via the fluid outlet. The inflow of bore fluid into the second chamber may assist in driving isolating fluid from the second chamber into the first chamber as the elongate medium is deployed. Where the first chamber is filled with gas, or partially filled with isolating fluid and partially filled with gas, fluid from the bore may enter the second chamber as gas from the first chamber exits therefrom via the fluid outlet.

The apparatus may further comprise the isolating fluid. In some examples, the isolating fluid may be provided into the cavity to occupy the vacant space of the chambers prior to deployment of the housing downhole. The spool of elongate medium may be fully immersed in isolating fluid prior to deployment of the apparatus downhole. The isolating fluid may be provided into the first and second chambers to occupy the vacant space of the first and second chambers, prior to deployment of the housing downhole.

In other examples, the isolating fluid may be provided into the cavity to occupy part of the vacant space of the chambers prior to deployment. The remaining space may be filled with gas, such as air. In one example, the spool of elongate medium may be partially immersed in isolating fluid prior to deployment. In other examples, the spool of elongate medium may not be immersed in isolating fluid at all prior to deployment, but instead a volume of isolating fluid may be provided in the housing between the spool of elongate medium and the inlet.

The isolating fluid may be immiscible with bore fluid, thus facilitating the formation of an interface between the isolating fluid and the bore fluid.

The isolating fluid may be at least one of the following: a water-based fluid, an oil-based fluid, a mixture of water-based and oil-based fluid. The isolating fluid may be water, or cesium formate, or a mixture thereof.

The housing may be deployed into the bore, for example by gravity and/or by pumping the housing into the bore. The housing may be configured to traverse the bore, for example under the action of gravity and/or by pumping the housing through the bore.

The spool of elongate medium may comprise any form of packaged arrangement which allows the elongate medium to be mounted within the spool cavity and deployable from the outlet. The elongate medium may comprise a first configuration in which the elongate medium is mounted within the spool cavity and a second configuration in which the elongate medium is deployed through the outlet.

In the first configuration, the elongate medium may be in a wound configuration, for example bundled, coiled, spooled or the like. The first configuration may comprise the elongate medium wound around a spool or bobbin, for example, wherein the bobbin is configured to be mounted within the housing. In the first configuration, at least some of the elongate medium may be configured to impart or assist with linear deployment of the elongate medium to the second configuration.

The second configuration may be such that the elongate medium provides one or more coiled portions in the bore. A coiled portion need not be helically wound, per se, but rather any bundle of elongate medium that could otherwise serve to provide increased resistance/sensitivity compared to other portions of the elongate medium. The elongate medium may comprise a first configuration so as to provide the coiled portions in the second configuration.

The spool or bobbin on which the elongate medium is wound may have an axial length. The axial length of the bobbin may vary in accordance with the application in which the apparatus is to be used. For example, the axial length of the bobbin may be 20%, 40%, 60% or 80% of the axial length of the apparatus.

Where the elongate medium is wound onto a bobbin, the bobbin may comprise a bobbin axis and, in the first configuration a length of elongate medium may be wound around the bobbin axis to form a plurality of wrap segments arranged axially along the bobbin axis, wherein adjacent wrap segments partially overlap in the axially direction. That is, one wrap segment may overlay an end region of an adjacent wrap segment Each wrap segment may comprise a first wrap layer wound in a first axial direction over a first axial distance, and a second wrap layer wound over the first wrap layer in a reverse second axial direction over a second axial distance greater than the first axial distance. The elongate medium may extend from the second wrap layer of one wrap segment to the first wrap layer of an adjacent wrap segment.

During deployment of the elongate medium, the wrap layers of one segment are unwound before being unwound from an adjacent wrap segment, and so on. In this way, deployment of the wrap segments are each sequentially depleted, one after the other, in an axial direction, which may be referenced as the depleting direction, along the bobbin axis. In this respect, during unspooling, the axial length of the spool of elongate material will reduce in the depleting direction. This contrasts with conventional spool arrangements in which unspooling does not affect the axial length of the spool of material (at least until the final layer is reached), with the diameter instead reducing as individual layers are depleted.

The apparatus may be configured to permit controlled deployment of the elongate medium in the bore. Various materials or techniques may be used to control deployment of the elongate medium. For example, wax, varnish, lacquer, grease, or any other material with semi sticky properties may be applied to the elongate medium to keep the elongate medium from deploying unintentionally.

In addition, the apparatus may further comprise a friction device. Such a friction device may be configured to impart a force to the elongate medium during deployment. In some cases, the force may be selective so as to selectively control deployment.

The elongate medium may be or comprise a line made from Vectran fibre, Kevlar fibre, monofilament polymer, steel, copper, glass fibre, fibre optic, or any other material that can be formed into a wire, thread, line or braid, and/or any combinations thereof. In some examples, the elongate medium may provide a signal communication path, for example, when comprising fibre optic, or the like.

The elongate medium may be or comprise a steel line, such as one or more steel wires.

The elongate medium may be or comprise a composite line, for example, made of a polymeric material, fibre optic, and/or steel, etc.

According to one example, the elongate medium may be made from, or comprise, a degradable material. Such a degradable material may be configured to degrade or dissolve in a wellbore environment, for example, in the presence of wellbore fluids comprising oil, water and/or mixtures thereof. However, it should be understood that in some cases where a degradable material is used the rate of degradation or dissolution may be such that it allows proper deployment of any associated tool or the like to a desired location within the wellbore prior to failure or degradation of the elongate medium.

The elongate medium may comprise one or more layers of a protective material, such as wax, to delay the onset of the degrading and/or dissolution effects as may be needed.

Suitable degradable materials may include materials that are dissolvable in oil and/or water. Suitable materials may comprise an effective amount of polysaccharides, chitin, chitosans, poly(ethylene oxides), poly(phenyllactide), polyphosphatenes and the like. Examples of suitable degradable materials may include materials used in dissolvable surgical suture applications such as polyvinyl alcohol (PVOH), polyvinyl acetate (PVA aka poly(ethenyl ethanoate)), polyglycolic acid (PGA) and the like or bioplastics used in utensils and packaging such as thermoplastic starch, cellulose-based plastics, aliphatic polyesters such as polyhydroxyalkanoates (PHAs) such as poly-3-hydroxybutyrate (PHB), polyhydroxyvalerate (PHV) and polyhydroxyhxanoate (PHH), and polylactic acid (PLA).

A suitable elongate medium may exhibit a sufficiently high strength, thermal stability and low stretch or deformation for supporting the weight of the apparatus including the self-weight of the elongate medium under the bore ambient temperature conditions.

The elongate medium may exhibit a sufficiently high strength, thermal stability and low stretch or deformation for supporting the flow-induced forces caused by the fluid flow around and along the elongate medium suspended in the well as injection and/or fracturing fluids are pumped into the well.

The elongate medium may be or comprise a composite member, for example, comprising an electrical and/or a fibre optic component to provide signal control, power and/or data communications as may be needed.

The elongate medium may be of any suitable diameter provided that the elongate medium is sufficiently thin to permit storing a sufficient length of the elongate medium on the available volume provided with or without a bobbin. In some examples, the elongate medium may have a diameter of 500 μm or less, such as 325 μm or less, or even around 25 μm or less.

The elongate medium may be retrievable. Any suitable retrieving mechanism may be used, for example, a "fishing reel" type device or mechanism.

The elongate medium may be or comprise a line capable of logging bore data. The elongate medium may be configured to permit distributed sensing. The elongate medium may be configured to permit distributed sensing in the bore in the second configuration.

The elongate medium may be or comprise a line capable of establishing data and/or signal communication between a first region of the elongate medium located within the bore and a surface device which may be operably connected to the elongate medium. The data and/or signal communication may be one-way or two-way communication. Signal communication may be used to control the operation of the apparatus, for example via a command signal generated at the surface.

The elongate medium may be or comprise optical fibre. The optical fibre may allow for sensing of wellbore conditions (e.g. logging wellbore data). The optical fibre may allow for distributed sensing of wellbore conditions.

The optical fibre may establish data and/or signal communication between a first region of the optical fibre located within the bore and a surface device which may be operably connected to the optical fibre. The data and/or signal communication may be a one-way or two-way communication.

The optical fibre may allow establishing data and/or signal communication between the apparatus and a surface device which may be operably connected to the fibre optic. The data and/or signal communication may be a one-way or two-way communication. For example, the surface device may include a light source. The light source may, by way of an example, comprise a laser and a surface interrogator of the type that may be used with fibre optic systems. For example, the light source may generate a light pulse at a desired frequency through the optic fibre which may then be backscattered to the surface interrogator. The surface interrogator may comprise software for analysing the received signals and deriving useful data such as the temperature, pressure, acoustics and the like at a region of the optical fibre deployed within the bore.

The apparatus may be configured to be deployed in an oil and gas bore, for example a wellbore.

The apparatus may be configured to be retrievable from the bore. This may allow the apparatus to be reusable in multiple operations if required.

The apparatus may be disposable within the bore. For example, the housing may be made of or comprise an effective amount of disposable material. Suitable disposable materials may include a polymer such as a polyolefin, a degradable or dissolvable polymer, a biodegradable material such as a biodegradable polymer, a dissolvable metal, a dissolvable metal alloy, a dissolvable metal composition, a frangible material such as a ceramic, or a glassy material, a frangible metal/ceramic material and/or the like. Having a housing made of disposable material may reduce the strength requirements of the apparatus since there is no requirement that the apparatus be retrieved to surface.

The apparatus may be deployable within a bore comprising a drilling mud, such as a water based drilling mud, oil based drilling mud and/or the like.

The apparatus may be deployable within a bore comprising a cement. The elongate medium, when deployed, may function to monitor curing or setting of the cement.

Another aspect of the present disclosure relates to a method of deploying an elongate medium in a bore. The method may comprise deploying an apparatus in a bore. The apparatus may comprise a housing defining an internal spool cavity and a spool of elongate medium mounted within the internal spool cavity. The method may comprise providing the housing comprising an isolating fluid. The isolating fluid may isolate the elongate medium from the bore fluid entering the housing. The method may comprise deploying an elongate medium from an outlet of the housing. The method may comprise receiving bore fluid via an inlet of the housing, as the elongate medium is deployed through the outlet.

The method may comprise deploying an elongate medium from an outlet of the housing. The method may comprise receiving bore fluid via an inlet of the housing as the elongate medium is deployed through the outlet, wherein the volume of bore fluid corresponds to the volume vacated by the deployed elongate medium.

The method may comprise locating the apparatus in a wellbore with its leading end substantially aligned with and facing its direction of travel. The direction of travel may coincide with an axial length of the wellbore and be in a direction away from the surface. The method may comprise orientating the apparatus above a wellbore immediately before deployment with its leading end substantially aligned with and facing its intended direction of travel. In this instance, the method may comprise orientating the apparatus in such a configuration that fluid within the housing of the apparatus moves towards the inlet.

Where the bore in which the elongate medium is deployed comprises only a liquid portion, the method may comprise providing the housing completely full of isolating fluid, which may be completed prior to deployment. In this respect, the method may comprise providing the elongate medium within the housing completely immersed in isolating fluid. Alternatively, the method may comprise providing the housing partially full of isolating fluid. The remaining space within the housing may comprise a gas, such as air. In this respect, the method may comprise providing the elongate medium within the housing partially immersed in isolating fluid and partially immersed in gas. Alternatively, the elongate medium may be fully immersed in gas, and the isolating fluid may occupy a space in the cavity capable of isolating the spool of elongate medium from bore fluid entering the cavity.

Where the bore in which the elongate medium is deployed comprises a liquid portion and a gas portion, the method may comprise providing the housing partially full of isolating fluid. The remaining space within the housing may comprise a gas, such as air. In this respect, the method may comprise providing the elongate medium within the housing partially immersed in isolating fluid and partially immersed in gas. Alternatively, the elongate medium may be fully immersed in gas, and the isolating fluid may occupy a space in the cavity capable of isolating the spool of elongate medium from bore fluid entering the cavity.

The method may comprise selecting an isolating fluid in accordance with one or more wellbore conditions. The isolating fluid may comprise clean bore fluid. The clean bore fluid may comprise fluid taken directly from a wellbore of a producing well, albeit in a cleaned or filtered condition. The isolating fluid may comprise bore fluid which may be used in an injection process, for example, to induce artificial lift in a well comprising lower-density fluids. Where the apparatus is deployed in a wellbore during the stages of drilling, for example, during an intervention process, the isolating fluid may comprise drilling mud in a cleaned or filtered condition. Such cleaning or filtering of the drilling mud may be achieved by the use of a shale shaker and/or suitable decontaminator, such as a UV filter.

The apparatus may be filled with the isolating fluid at the site of deployment, or instead the apparatus may be filled offsite and delivered ready for deployment. Such onsite or offsite filling may be achieved by submerging the apparatus in a volume of isolating fluid. Alternatively, the apparatus may be filled with isolating fluid by inducing a flow of isolating fluid into the apparatus via the inlet and/or outlet of the apparatus, for example, by pumping or manually pouring the isolating fluid into the apparatus.

When deployed, the bore fluid may act on the apparatus with an upward, buoyant force as it traverses the wellbore. It may therefore be desirable in some applications to ensure that the weight of the apparatus when deployed is sufficient to overcome any buoyant forces that may act on the apparatus. In this respect, the isolating fluid may be selected in accordance with density. For example, the isolating fluid may be selected such that the weight of the apparatus in use is sufficient to sustain downward movement thereof within the wellbore against the buoyancy of the bore fluid.

The apparatus may be provided with a tractor to drive the apparatus through the wellbore. Where the apparatus is provided with such a tractor, the isolating fluid may be of any density.

The method may comprise providing a spool or bobbin within the internal spool cavity. The bobbin may have an axial length. The axial length of the bobbin may vary in accordance with the application in which the apparatus is to be used. For example, the axial length of the bobbin may be 20%, 40%, 60% or 80% of the axial length of the apparatus.

The method may comprise isolating the spool of elongate medium from the bore fluid which enters the cavity during the complete deployment of the elongate medium.

An interface may be defined between the isolating fluid and the bore fluid entering the spool cavity. The method may comprise maintaining the spool of elongate medium in a non-contact relationship with the interface during the deployment of the elongate medium.

The method may comprise deploying the elongate medium at a rate which is selected to provide a volumetric increase of a vacant space within the spool cavity which is equal to the rate of intake of the bore fluid. This may ensure that the elongate medium is kept isolated from the bore fluid as the elongate medium is deployed.

The method may comprise deploying the elongate medium such that the volume occupied by the spool of elongate medium decreases from one end of the spool cavity to the other. This may act to maintain the spool of elongate medium in the non-contact relationship with the interface between the isolating fluid and the bore fluid.

The method may comprise filling the internal spool cavity with isolating fluid such that the spool of elongate medium may be completely immersed in the isolating fluid prior to deployment.

Alternatively, the method may comprise partially filling the internal spool cavity with isolating fluid such that the elongate medium may be partially immersed in isolating fluid. Alternatively, in this instance, the elongate medium may not at all be immersed in isolating fluid, and instead, a volume of isolating fluid may be provided in the housing between the spool of elongate medium and the inlet such that the spool of elongate medium may be isolated from bore fluid entering the housing via the inlet.

The internal spool cavity may comprise a first chamber and a second chamber, the spool of elongate medium being mounted within the first chamber, and wherein the first and second chambers are configured to be in fluid communication. The method may comprise permitting isolating fluid provided in the second chamber to be received within the first chamber to fill the volume within the first chamber which has been vacated by the deployed elongate medium.

The method may comprise providing the isolating fluid within at least the second chamber. The method may comprise providing the isolating fluid within the first chamber to fill the free volume around the spool of elongate medium prior to deployment of the apparatus in the bore. The isolating fluid may also flow out of the outlet, or from a separate fluid outlet, as the elongate medium is deployed.

Providing the isolating fluid within the internal spool cavity prior to deployment of the apparatus in the bore may comprise submerging the apparatus in a volume of isolating fluid. A fluid tank of a selected volume may be used for the submersion. The isolating fluid may be poured into the cavity of the housing using any suitable means.

The method may further comprise permitting a flow of bore fluid into the second chamber as the elongate medium is deployed through the outlet. The flow of bore fluid into the second chamber may assist in driving the fluid from the second chamber into the first chamber to fill the vacated volume of the deployed elongate member.

Deploying the apparatus in the bore may comprise pumping the apparatus into the bore, and/or allowing the apparatus to traverse the bore under the action of gravity.

The method may comprise filling the vacant space defined by the internal spool cavity partially with the isolating fluid and partially with a gas, prior to deployment, to isolate the elongate medium from bore fluid entering the cavity. The gas, for example, may comprise air. In this instance, the bore in which the elongate medium is deployed may be a wellbore comprising a portion of gas.

The method may comprise filling the vacant space defined by the internal spool cavity completely with the isolating fluid, prior to deployment, to isolate the elongate medium from bore fluid entering the cavity. In this instance, the bore in which the elongate medium is deployed may be a wellbore comprising bore fluid without any gas.

The method may further comprise providing the apparatus with a filter and filtering at least a portion of the isolating fluid prior to the portion of isolating fluid occupying the volume within the internal spool cavity vacated by the deployed elongate medium. The method may comprise filtering bore fluid received in the housing, for example, by the provision of a filter at the inlet.

For example, a filter may be provided between the first and second chambers and the method may comprise filtering the isolating fluid, and/or bore fluid before it is received into the first chamber. Filtering fluid prior to the fluid being received into the first chamber may provide an additional means to prevent damage to the elongate medium or the deployment process. The filtering may also comprise filtering bore fluid to a suitable level of purity in the event that bore fluid passes from the second chamber to the first chamber.

The method may comprise mounting the spool of elongate medium in a first configuration within the internal spool cavity, for example, within the first chamber. The mounting may comprise winding the elongate medium into a wound configuration, for example bundled, coiled, spooled, etc. The mounting may comprise winding the elongate medium around a bobbin and mounting the bobbin within the housing. In the first configuration, at least some of the elongate medium may be configured to impart or assist with linear deployment of the elongate medium to the second configuration.

The method may comprise deploying the elongate medium to a second configuration. The second configuration may be such that the elongate medium provides one or more coiled portions in the bore. A coiled portion need not be helically wound, per se, but rather any bundle of elongate medium that could otherwise serve to provide increased resistance/sensitivity compared to other portions of the elongate medium.

Mounting the elongate medium in the first configuration may comprise arranging or winding the elongate medium to provide the coiled portions in the second configuration.

The elongate medium may be configured to permit distributed sensing in the bore, and the method may comprise using the deployed elongate medium for distributed sensing in the bore. The elongate medium may be or comprise a line capable of logging bore data, and the method may comprise logging bore data.

The method may comprise using the deployed elongate medium to establish data and/or signal communication between a first region of the bore and a second region of the bore. The apparatus may comprise an on-board electrical system, which may be configured for communication.

The elongate medium may be or comprise a line capable of establishing data and/or signal communication between a first region of the elongate medium located within the bore and a surface device, for example, a transmitter and/or receiver, which may be operably connected to the elongate medium. The data and/or signal communication may be one-way or two-way communication. The method may comprise controlling the operation of the apparatus using signal communication.

The method may comprise disposing of the apparatus in the bore, for example, leaving the apparatus in the bore after the elongate medium has been deployed. The method may comprise retrieving the apparatus from the bore. The method may comprise retrieving the elongate medium from the bore.

Another aspect of the present disclosure relates to a kit for deploying an elongate medium in a bore. The kit may comprise an apparatus configured to be deployable in a bore, the apparatus comprising a housing defining an internal spool cavity, an outlet and an inlet; and a spool of elongate medium mounted within the spool cavity. The kit may comprise a fluid tank. The fluid tank may be configured to contain a volume of an isolating fluid.

The kit may comprise a volume of the isolating fluid. In one example, the volume of the isolating fluid may be sufficient to at least partially immerse the spool of elongate medium mounted within the internal spool cavity. In another example, the volume of the isolating fluid may be sufficient to a fill a portion of the cavity such that the volume of the isolating fluid is capable of isolating the elongate medium from the bore fluid entering the housing via the inlet. Where the cavity comprises a first and second chamber, the volume of isolating fluid may be selected for example to at least fill the second chamber of the apparatus.

The elongate medium may be configured to allow for distributed sensing in the bore. The kit may also comprise a surface device configured to be connected to the elongate medium to establish one-way or two-way communication.

Another aspect of the present disclosure relates to a method of preparing an apparatus for the deployment of an elongate medium in a bore. The method may comprise completely filling an apparatus comprising a housing for an elongate medium with an isolating fluid. The method may comprise completely filling an internal spool cavity of the housing with the isolating fluid. The method may comprise completely filling a first and second chamber of the internal spool cavity with the isolating fluid.

Another aspect of the present disclosure relates to a method of preparing an apparatus for the deployment of an elongate medium in a bore. The method may comprise partially filling an apparatus comprising a housing for an elongate medium with an isolating fluid. The method may comprise filling the remaining space within the apparatus with a gas. The method may comprise partially filling an internal spool cavity of the housing with the isolating fluid. The method may comprise filling the remaining space within the cavity with a gas. The method may comprise partially filling one or both of the first and second chambers of the internal spool cavity with the isolating fluid.

The method may comprise filling the apparatus, for example, at the site of deployment of the apparatus, such as at the surface of a bore. Filling the apparatus may comprise submerging the apparatus in a volume of the selected fluid. The apparatus may be arranged such that, for example, during submersion, the isolating fluid displaces any fluid or gases which are initially present in the apparatus.

The method may comprise providing the elongate medium within a housing of the apparatus. Providing an elongate medium within a housing may comprise mounting a spool of elongate medium in the housing. The method may comprise winding the elongate medium on a bobbin for mounting in the housing.

The method may comprise providing an apparatus for deployment of an elongate medium with a filter. The filter may be provided to filter bore fluid received within the apparatus during deployment of the elongate medium. The filter may be provided to filter isolating fluid.

Another aspect of the present disclosure relates to a method of preparing an apparatus in situ in a lubricator stack positioned on top of a wellbore.

The apparatus may be initially provided in an unfilled condition inside the lubricator stack, prior to deployment in the wellbore. The lubricator stack may be required to undergo a pressure test where the lubricator stack may be filled with a pressurised fluid, such as a water-based liquid.

In this instance, the lubricator stack may be filled with the pressurised fluid, which may be achieved by pumping fluid through a valve connected to the lubricator stack. As the pressurised fluid beings to fill the lubricator stack, the fluid may enter the apparatus via the inlet of the apparatus.

The pressurised fluid may be selected in accordance with the isolating fluid of the apparatus. For example, the pressurised fluid may be selected such that it can also be used as the isolating fluid of the apparatus. In this respect, the cavity of the apparatus may be filed with the isolating fluid in situ in the lubricator prior to deployment. When the pressure test is complete, the apparatus may be ready for deployment in the wellbore.

The inlet of the apparatus may be provided with a one-way valve, which may permit fluid to enter the cavity and prevent fluid from exiting the cavity. As such, this may provide for the cavity to be filled with isolating fluid through the inlet while also being able to retain the isolating fluid in the cavity thereafter.

Once the pressure test is complete, the fluid may be removed from the lubricator stack. The apparatus, however, may remain completely full of fluid, for example, by virtue of the one-way valve. As noted, the fluid used in the pressure test may be selected to function also as the isolating fluid of the apparatus. Therefore, at this stage, the apparatus may be ready for deployment in a wellbore.

Where the lubricator stack sits on top of a wellbore having bore fluid comprising a portion of liquid and a portion of gas, the apparatus may be provided with a draining mechanism. The draining mechanism may be configured to drain the apparatus such that it is partially filled with isolating fluid prior to deployment in the wellbore. In this instance, when the pressure test is complete, the pressurised fluid may be drained from the lubricator stack. As fluid is drained from the lubricator stack, fluid from the apparatus may also be drained. Such draining of the apparatus may be achieved by the draining mechanism. The draining mechanism may comprise a valve connected to the apparatus. The valve may be located on a side face of the apparatus, at any suitable position between the leading end of the apparatus and the trailing end of the apparatus. The valve may be configured to be opened by receiving a wireless activation signal. The valve may be configured to be opened manually. The provision of such a valve may provide for the apparatus to be partially filled with isolating fluid and partially filled with gas immediately before deployment in a lubricator stack, if so required by the application.

It should be understood that any features described in relation to one example, aspect or embodiment may also be used in relation to any other example, aspect or embodiment.

Other advantages of the present apparatus and methods will become apparent to a person skilled in this art from the detailed description in association with the following drawings.

BRIEF DESCRIPTION OF THE DRAWINGS

These and other aspects of the present disclosure will now be described, by way of example only, with reference to the accompanying figures, in which.

DETAILED DESCRIPTION OF THE DRAWINGS

Aspects of the present disclosure relate to the deployment of an elongate medium in a wellbore, such as an oil and/or gas wellbore. In particular, an apparatus for deploying an elongate medium in a bore configured such that an elongate medium may be deployed from the apparatus as the apparatus traverses through a bore. Elongate media, such as optical fibres, can be damaged or compromised and the deployment process can be hindered by exposure to environmental conditions in the bore; in particular, drilling mud (e.g., oil and/or water based drilling mud) which has been weighted with ground barium powder has been shown to cause damage to optical fibres. The apparatus may be configured to reduce the risk of damage to the elongate medium and/or hindering of the deployment process, for example, by preventing fluid from the bore entering the portion of the apparatus containing the elongate medium, or by reducing the exposure of the elongate medium in the apparatus to bore fluid. Of course, the apparatus may be used in many applications or environments, and may be used to deploy any type of elongate medium where the same advantages may be realised.

With reference to FIGS. 1*a* to 1*d*, there are shown diagrammatic illustrations of an example apparatus 10 according to the present disclosure.

Figures 1A, 1B, 1C, 1D:
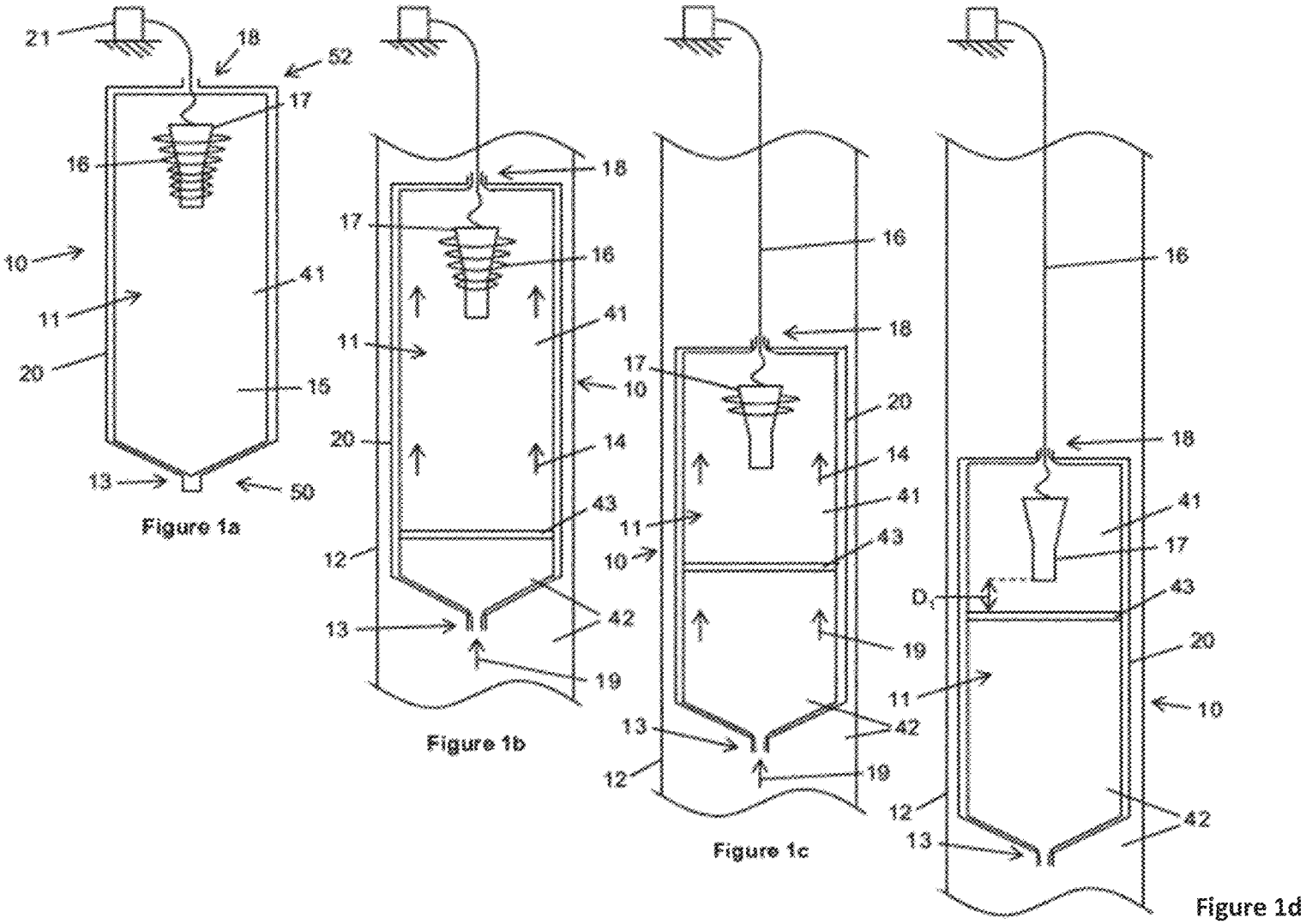
FIGS. 1*a* to 1*d* are diagrammatic illustrations of an apparatus according to the present disclosure in use in a wellbore.

FIG. 1*a* illustrates the apparatus 10 prior to deployment. The apparatus 10 comprises a housing 20, including an internal spool cavity 11, an inlet 13 and an outlet 18. The apparatus 10 defines a leading end 50 and a trailing end 52, the leading end 50 being substantially aligned with and facing the direction of travel of the apparatus 10 in use. The inlet 13 is provided at the leading end 50 of the apparatus 10, and the outlet 18 is provided at the trailing end 52 of the apparatus 10. Immediately before deployment, the apparatus 10 may be orientated above a wellbore 12 with its leading end substantially aligned with and facing its intended direction of travel.

The internal spool cavity 11 includes an elongate medium 16 wound around a spool or bobbin 17. The elongate medium 16 may be used during or after deployment for multiple applications. In some examples, the elongate medium 16 may be used for communication and/or distributed sensing within the wellbore 12, such as distributed temperate sensing (DTS), distributed pressure sensing (DPS), distributed acoustic sensing (DAS), or the like.

The cavity 11 is configured to contain an isolating fluid 41. The isolating fluid 41 may comprise any fluid, in particular, any liquid. The isolating fluid 41 may be selected in accordance with the application in which the apparatus 10 is used. In some examples, the isolating fluid may be selected to have a particular density and/or viscosity. In some examples, the isolating fluid 41 may comprise clean bore fluid (such as unused bore fluid or previously used and cleaned bore fluid). The bore fluid may comprise a completion fluid, or the like. In other examples, the isolating fluid 41 may comprise a water-based fluid, or cesium formate, or a mixture thereof.

Prior to deployment, as shown in FIG. 1*a*, the cavity 11 is completely filled with an isolating fluid 41. The cavity 11 is arranged to surround the elongate medium 16 within the housing 20. In one example, the isolating fluid 41 may comprise clean bore fluid, such as that discussed above. Using bore fluid may ensure that the density of the isolating fluid 41 is sufficient such that the apparatus 10 continually moves downwards through the bore fluid 42 within the wellbore 10 during deployment of the elongate medium 16. That is, the apparatus 10 may have a negative buoyancy when deployed.

As shown in FIG. 1*a*, the elongate medium 16 is connected to a surface device 21, which may include a transmitter and/or receiver. The surface device 21 may be located at the surface, however the device 21 may be located equally downhole at a point along a wellbore.

FIG. 1*b* illustrates the apparatus 10 in use at a first stage of deployment in a wellbore 12. As the apparatus 10 traverses the wellbore 12, the elongate medium 16 is deployed from the outlet 18 as it unspools from the bobbin 17. Consequently, the volume of elongate medium 16 occupying the cavity 11 is reduced as the elongate medium 16 is deployed. In this example, such deployment of the elongate medium 16 results in the isolating fluid 41 moving towards the outlet 18 as it fills the space vacated by the deployed elongate medium 16, as indicated generally by arrow 14. Concurrently, bore fluid 42 from the wellbore enters the cavity 11 via the inlet 13, as indicated generally by arrow 19. Such movement of the isolating fluid 41 and bore fluid 42 may provide for the apparatus 10 to be pressure compensated as the apparatus 10 traverses the wellbore 12 and the elongate medium 16 is deployed.

As bore fluid 42 enters the cavity 11, a fluid-fluid interface 43 is established between the isolating fluid 41 and the bore fluid 42. Such an interface may be achieved by selecting an isolating fluid 41 that is immiscible with the bore fluid 42. Alternatively, this may be achieved by selecting an isolating fluid 41 with sufficient viscosity such that mixing with bore fluid is prevented or minimised; however, the isolating fluid 41 should not be so viscous that it inhibits proper unspooling of the elongate medium 16. The apparatus 10 may be configured to traverse the wellbore 12 such that agitation and/or turbulence of the apparatus 10, and therefore fluid within the cavity 11, may be eliminated or minimised. For example, this may be achieved by configuring the apparatus 10 such that it is streamlined as it traverses the wellbore 12. For example, this may be particularly desirable where the isolating fluid 41 comprises bore fluid. In this instance, the isolating fluid 41 may have similar properties to the bore fluid 42 entering the apparatus 10. As such, the bore fluid 42 may be capable of mixing with the isolating fluid 41, which would thereby break the interface 43. Configuring the apparatus 10 to traverse the wellbore 12 such that agitation and/or turbulence is eliminated or minimised may assist to ensure the interface 43 is maintained throughout the entire deployment of the elongate medium 16.

In one example, the volume of bore fluid 42 entering the cavity 11 via the inlet 13 may be equal to the volume within the cavity 11 that has been vacated by the deployed elongate medium 16. However, in other examples, a portion of the isolating fluid 41 may be vacated alongside the elongate medium 16 as it is deployed, for example, due to the boundary layer effect. In this respect, the volume of bore fluid 42 entering the cavity 11 may be equal to the volume within the housing 20 that has been vacated by the deployed elongate medium 16 and isolating fluid 41.

FIG. 1*c* illustrates the apparatus 10 at a second stage of deployment in the wellbore 12. At this stage, the apparatus 10 has traversed further into the wellbore 12 and more of the elongate medium 16 has been deployed. Consequently, a larger volume of elongate medium 16 has vacated the cavity 11, and a larger volume of bore fluid 42 has entered the cavity 11. As such, the interface 43 has advanced within the housing 20 towards the outlet 18. The elongate medium 16 is configured such that it depletes from one end of the bobbin 17 to the other, starting at the end of the bobbin 17 closest to the inlet 13 of the apparatus 10. As illustrated in this example, the apparatus 10 is configured such that the interface 43 is maintained at a distance from the spool of the elongate medium 16. Therefore, the spool of elongate medium 16 and bore fluid 42 remain in a non-contact relationship throughout the deployment of the elongate medium 16.

FIG. 1*d* illustrates the apparatus 10 at a third stage of deployment in the wellbore 12. At this stage, the apparatus 10 has traversed further into the wellbore 12, and all of the elongate medium 16 has been deployed. Consequently, a larger volume of elongate medium 16 has vacated the cavity 11, and a larger volume of bore fluid 42 has entered the cavity 11. As such, the interface 43 has advanced further within the housing 20 towards the outlet 18; however, the bobbin 17 and interface 43 remain separated in this example, being spaced apart by a distance D1, such that the bobbin 17 and elongate medium 16 remain in a non-contact relationship with the advancing interface 43 throughout the entire deployment of the elongate medium 16.

The apparatus 10 of the present example may provide for the elongate medium 16 within the cavity 11 to be protected from damaging exposure to bore fluid 42 during deployment thereof.

Although not illustrated in the Figures, the use of the apparatus 10 may involve any number of subsequent stages, which, for example, may involve abandonment or retrieval of the apparatus 10 and/or elongate medium 16. In some examples, the elongate medium 16 may be used for distributed sensing within the wellbore 12, such as distributed temperate sensing (DTS), distributed pressure sensing (DPS), distributed acoustic sensing (DAS), or the like. The apparatus 10 may be provided with an on-board electrical system, which, for example, may be used for communication.

The previous example illustrates the apparatus 10 in use in a wellbore that is full of bore fluid comprising only a liquid portion. However, in other examples, the apparatus 10 may be used in a wellbore that also comprises a portion of gas, for example, a gas cap above the liquid portion. When the apparatus 10 is used in such a wellbore, the elongate medium 116 is deployed through two different environments; initially the gas portion followed by the liquid portion. During deployment of the elongate medium 16 through the gas portion of the wellbore, the apparatus 10 may experience a significantly smaller drag force than when compared to traversing the liquid portion. As such, the velocity at which the apparatus 10 traverses the gas portion may be substantially greater than that when in the liquid portion. Therefore, the rate of deployment of the elongate medium 16 from the cavity 11 may be substantially greater in the gas portion.

Without wishing to be bound by theory, the present inventor has discerned that such an increase in velocity of the apparatus, and thus an increase in the rate of deployment of the elongate medium, through the gas portion of the wellbore may have an adverse effect on the interaction between the unspooling elongate medium and the isolating fluid. For example, the increased rate of the unspooling of the elongate medium may impart on an isolating fluid within the cavity an increased rotational velocity. Such an increase in rotational velocity of the isolating fluid may cause vortices to form, which may result in cavitation of the isolating fluid. Such a scenario may be detrimental to the deployment of the elongate medium and/or the structural integrity of the apparatus.

FIGS. 2*a* to 2*d* illustrate the apparatus 10 of FIGS. 1*a* to 1*d* being used in connection with a wellbore 60 having bore fluid 42 comprising a liquid portion 47 as well as a gas portion 44. In this example, the gas portion 44 is a gas cap.

Figures 2A, 2B, 2C, 2D:
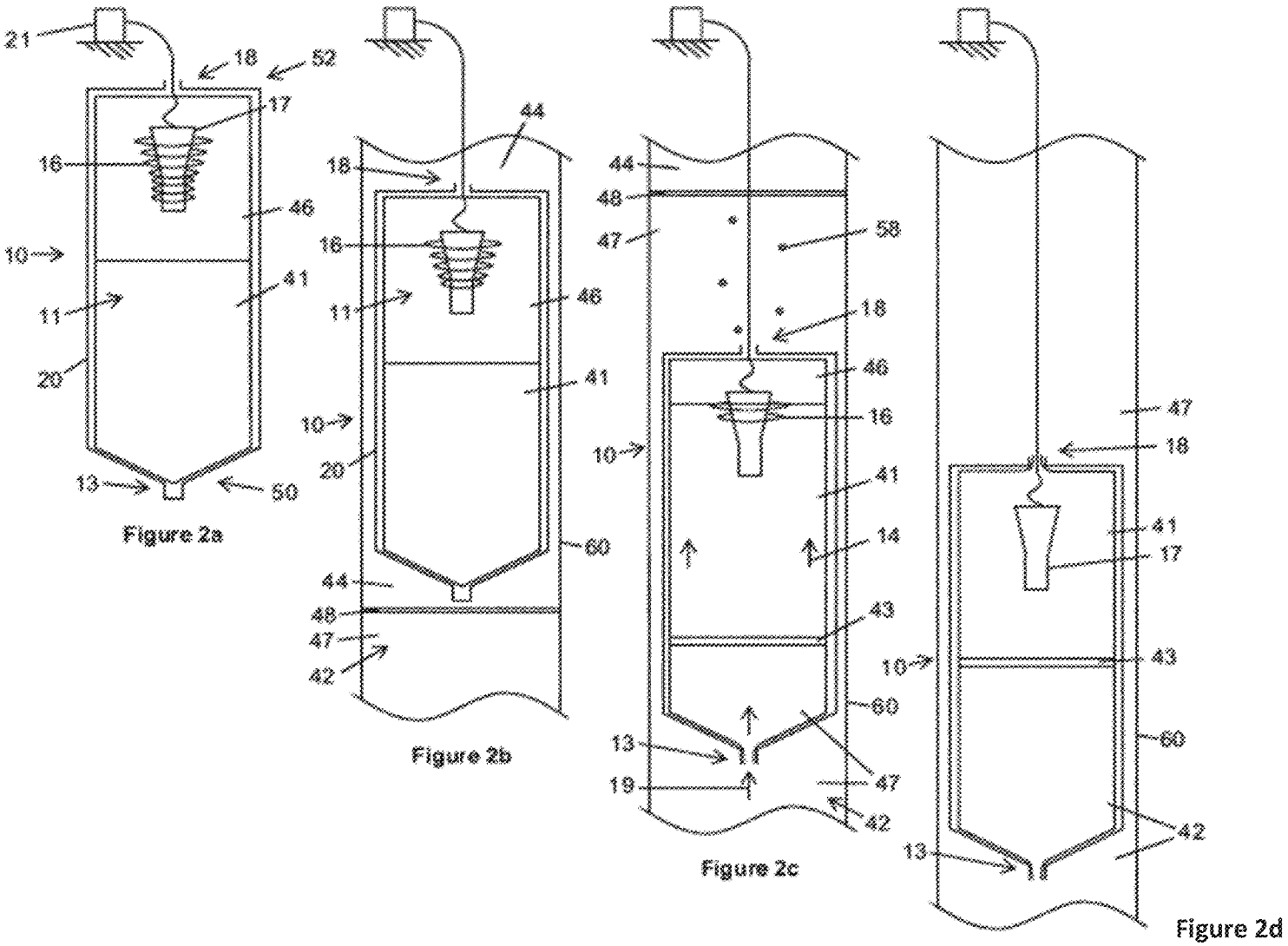
FIGS. 2*a* to 2*d* are diagrammatic illustrations of the apparatus of FIGS. 1*a* to 1*d* in use in a wellbore having a portion of gas.
Figures 3A, 3B, 3C, 3D:
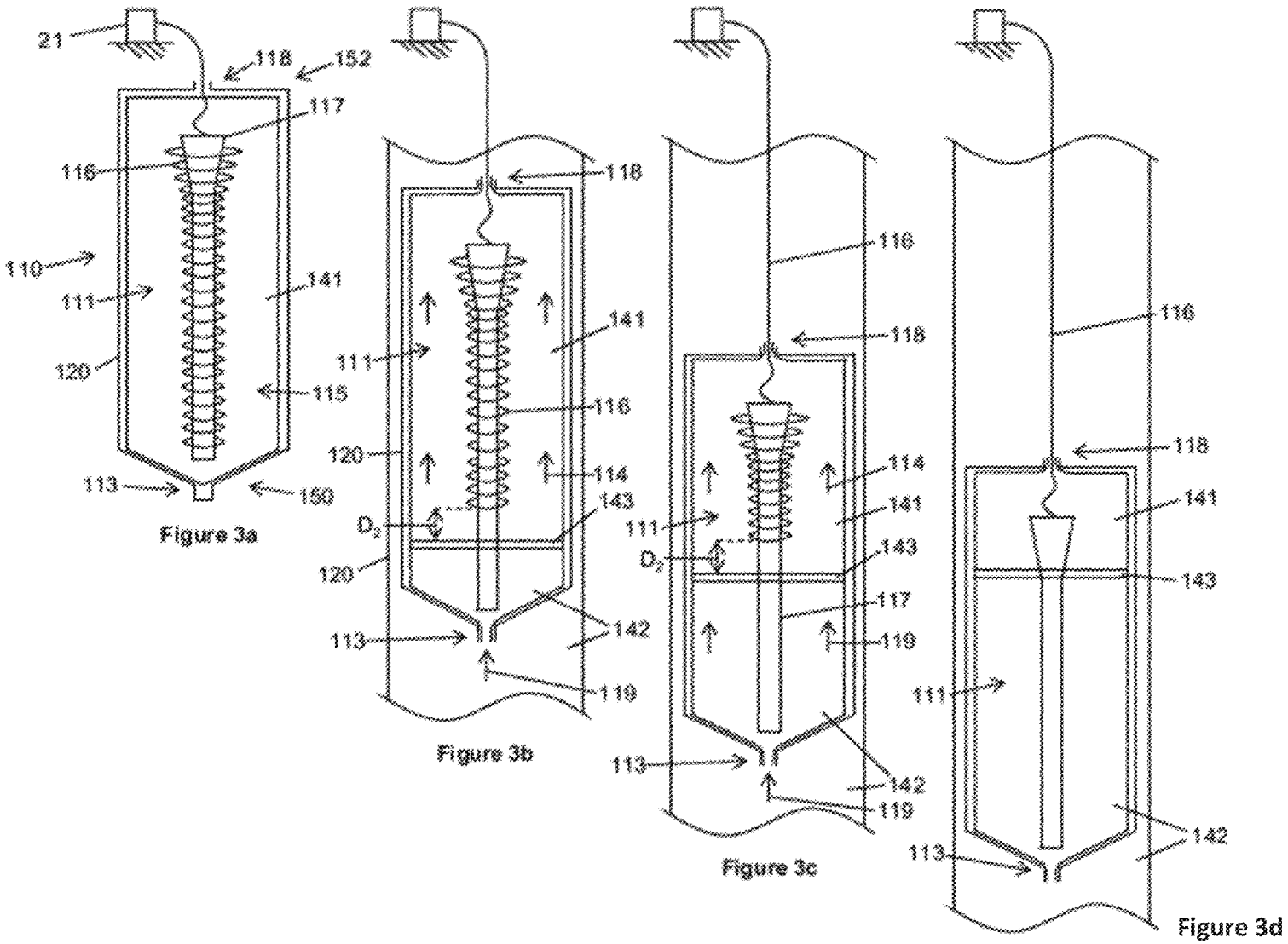
FIGS. 3*a* to 3*d* are diagrammatic illustrations of an alternative apparatus according to the present disclosure in use a wellbore.

FIG. 2*a* illustrates the apparatus 10 prior to deployment. As with the previous examples, the apparatus 10 comprises a housing 20, including an internal spool cavity 11, an inlet 13 and an outlet 18. The internal spool cavity 11 is configured to contain an isolating fluid 41 and an elongate medium 16 wound around a bobbin 17. Furthermore, the elongate medium 16 extends through the outlet of the apparatus to connect to a surface device 21.

In this example, the cavity 11 is only partially filled with an isolating fluid 41 prior to deployment. As shown in FIG. 2*a*, the cavity 11 is approximately 50% filled with isolating fluid 41 from the leading end 50 of the apparatus 10; however, this is not essential. In other examples, the cavity may be less than 50% full, such as 15% full, 25% full, etc., or more than 50% full, such as 75% full, 85% full, etc. The remaining volume of the cavity 11 at the trailing end 52 of the apparatus 10 is filled with a gas 46, which in this example is air.

FIG. 2*b* illustrates the apparatus 10 at a first stage of deployment in the gas portion 44 of the wellbore, which is a gas cap. The gas portion 44 is separated from the liquid portion 47 by a gas-fluid interface 48 within the wellbore 60. As with the previous example, the elongate medium 16 is deployed from the outlet 18 as the apparatus 10 traverses the wellbore 60. As such, the volume of elongate medium 16 occupying the cavity 11 is reduced. However, as shown in FIG. 2*b*, the isolating fluid 41 remains substantially in its initial configuration. At this stage, the apparatus 10 has not yet entered the liquid portion 47 of the wellbore 60, and as such, no bore fluid 42 has entered the cavity 11 to drive the isolating fluid 41 towards the outlet 18. Hence, this allows for the elongate medium 16 within the cavity 11 to be substantially surrounded by gas 46, rather than isolating fluid 41, during the increased rate of deployment and unspooling of the elongate medium 16. Such an arrangement may reduce the likelihood of adverse interactions of the unspooling elongate medium in a liquid isolating medium. This may provide for a smooth, reliable deployment of the elongate medium without the risk of damage to the structural integrity of the apparatus 10.

FIG. 2*c* illustrates the apparatus 10 at a second stage of deployment. At this stage, the apparatus 10 has traversed further into the wellbore 60 and is below the interface 48, submerged in the liquid portion 47 of the wellbore 60. As shown in FIG. 2*c*, bore fluid 42 from the liquid portion 47 of the wellbore 60 now enters the cavity 11 via the inlet 13, as indicated generally by arrow 19, thus establishing the fluid-fluid interface 43. Furthermore, as bore fluid 42 enters the cavity 11 the isolating fluid 41 moves towards the outlet 18, as indicated generally by arrow 14. This causes the gas 46 within the cavity 11 to be displaced out of the cavity 11 and into the wellbore 60 via outlet 18, as illustrated by the formation of bubbles 58 in the bore fluid 42 of the wellbore 60.

FIG. 2*d* illustrates the apparatus 10 at a third stage of deployment. At this stage, the apparatus 10 has traversed further into the wellbore 12 and all of the elongate medium 16 has been deployed. As shown in FIG. 2*d*, the interface 43 has advanced further within the cavity 11 such that all of the gas 46 has been displaced therefrom. It will be appreciated, however, that the gas 46 will be fully displaced from the cavity 11 shortly after the apparatus 10 enters the liquid portion 47 of the wellbore 60, and thus well before the illustrated third stage of deployment in FIG. 2*d*. At this stage, immediately after the gas 46 has been fully displaced from the cavity 11, the spool of elongate medium 16 would become fully immersed in isolating fluid 41.

The skilled person will appreciate that the apparatus of FIGS. 2*a* to 2*d* will function in the same way regardless of the location of the gas-fluid interface 48 in the wellbore 60. Indeed, the apparatus of FIGS. 2*a* to 2*d* may also be used in a wellbore comprising bore fluid 42 having only a liquid portion, for example, like the wellbore 12 of FIGS. 1*a* to 1*d*. In this instance, upon deployment of the apparatus 10, bore fluid 42 from the wellbore would immediately enter the cavity 11 via the inlet 13, the gas 46 would immediately displace from the cavity 11, and the apparatus 10 would thereafter function in the same way as the apparatus of FIGS. 1*a* to 1*d*.

Referring to FIGS. 3*a* to 3*d*, there are shown diagrammatic illustrations of an alternative apparatus of FIGS. 1*a* to 1*d*. The alternative apparatus of FIGS. 3*a* to 3*d* is similar in many respects to the apparatus of FIGS. 1*a* to 1*d*, and therefore like features are denoted by like numerals incremented by 100.

In this alternative apparatus, the axial length of the bobbin 117 is greater than the axial length of the bobbin 17 of FIGS. 1*a* to 1*d*. In this example, the apparatus 110 is used in connection with a wellbore 120 comprising bore fluid 142 that consists only of liquid, and not gas. As such, the cavity 111 has been completely filled with isolating fluid 141 prior to deployment. The bobbin 117 and elongate medium 116 occupy substantially more of the volume of the cavity 111 in this arrangement, and thus the vacant space 115 in the cavity 111 is less. As such, the isolating fluid required to fill the cavity 111 is less than that required to fill the cavity 11 of the apparatus of FIGS. 1*a* to 1*d*.

The elongate medium 116 is deployed from the outlet 118 as the apparatus 110 traverses the wellbore 112. The volume of elongate medium 116 occupying the cavity 111 is thereby reduced, and bore fluid 142 from the wellbore 120 enters the cavity 111 via the inlet 113, such that pressure is balanced throughout the apparatus 110. Again, an interface 143 is established between the isolating fluid 141 and the bore fluid 142, which advances through the cavity 111 as the elongate medium 116 is deployed.

In this example, the spool of elongate medium 116 is configured such that it depletes from one end of the bobbin 117 to the other. As such, the interface 143 may remain positioned relative to the elongate medium 116 such that as the elongate medium 116 is deployed, the elongate medium 116 within the cavity 111 is immersed in isolating fluid 141, and isolated from bore fluid 142. As shown, a distance D2 is maintained between the elongate medium 116 within the cavity 111 and the advancing interface 143 as the elongate medium 116 is deployed. The distance D2 may vary as the elongate medium 116 is deployed, but should never reach zero so as to avoid bore fluid 142 contacting the elongate medium 116. This may be achieved by the manner in which the elongate medium 116 is mounted or wound on the bobbin 117. For example, the elongate medium 116 may be mounted on the bobbin 117 such that the elongate medium 116 depletes in an axial direction away from the advancing interface 143.

Figures 4A, 4B, 4C, 4D:
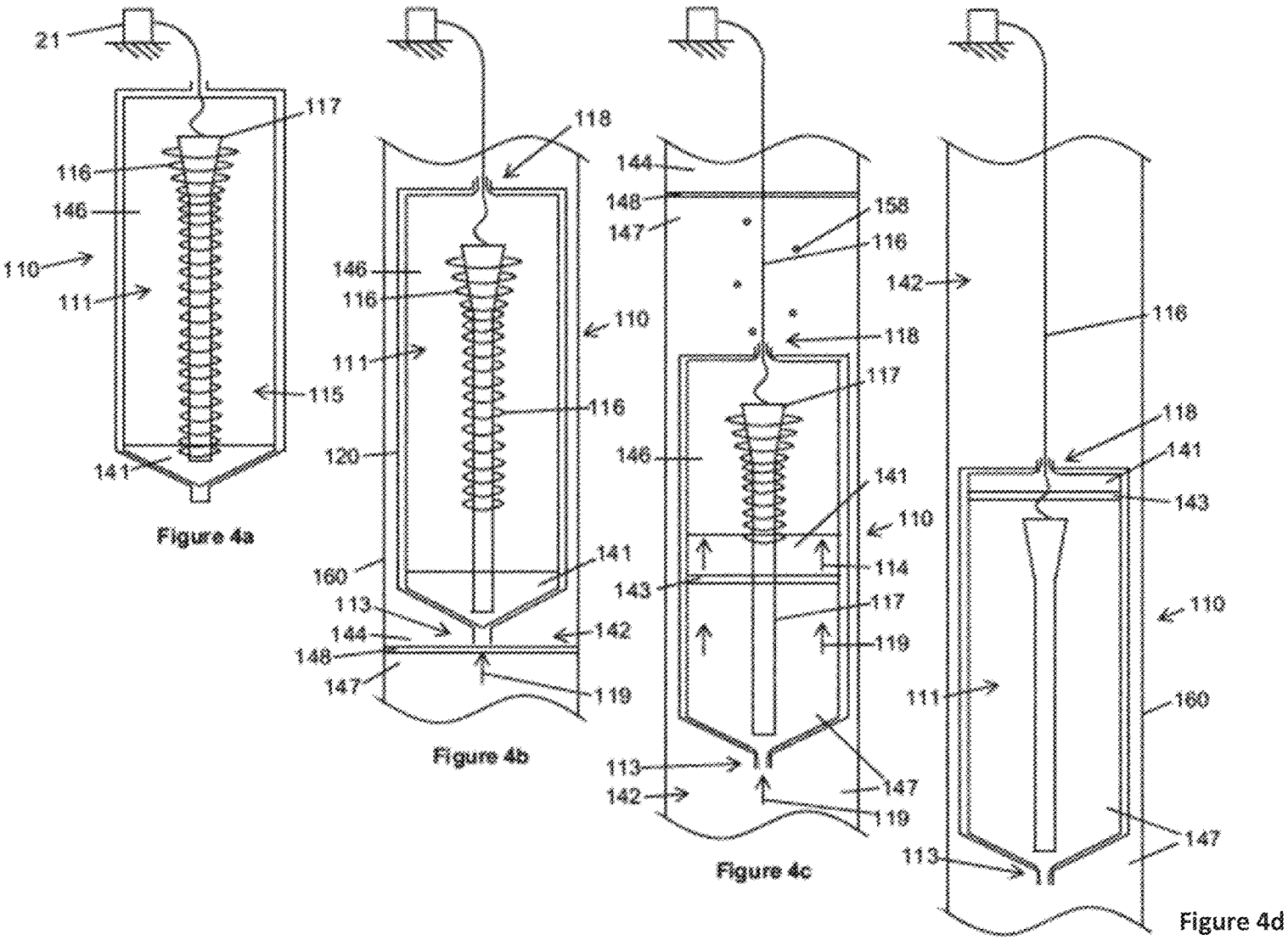
FIGS. 4*a* to 4*d* are diagrammatic illustrations of the alternative apparatus of FIGS. 3*a* to 3*d* in use in a wellbore having a portion of gas.

FIGS. 4*a* to 4*d* illustrate the apparatus 110 of FIGS. 3*a* to 3*d* where the cavity has been partially filled with isolating fluid 141. FIG. 4*a* illustrates the apparatus 110 prior to deployment. In this example, the apparatus 110 is used in a wellbore having bore fluid 142 comprising a liquid portion 147 and a gas portion 144, much like the wellbore 60 of FIGS. 2*a* to 2*d*. As such, the cavity 111 has been filled partially with an isolating fluid 141. In this example, the isolating fluid 141 occupies less of the cavity 111 than that of the isolating fluid 41 in the cavity 11 of FIGS. 2*a* to 2*d*. However, it should be understood that any volume of isolating fluid 141 may be selected that is sufficient to sustain the interface 143 between the isolating fluid 141 and bore fluid 142 entering the cavity 111, such that the spool of elongate medium 116 remains isolated from the bore fluid 142 during deployment of the elongate medium 116.

FIG. 4*b* illustrates the apparatus 110 at a first stage of deployment in a wellbore 160. In this example, the wellbore 160 consists of a liquid portion 147 and a gas portion 144 separated by a gas-fluid interface 148; however, such a filling process would enable the apparatus 110 to be used equally in a wellbore consisting only of a liquid portion, much like the wellbore 120 of FIGS. 3*b* to 3*d*. In such a scenario, upon deployment of the apparatus 110, bore fluid 142 from the wellbore would immediately enter the cavity 111 via the inlet 113, the gas 146 would immediately displace from the cavity 111, and the apparatus 110 would thereafter function in the same way as the apparatus 110 of FIGS. 3*a* to 3*d*.

As with the previous examples, the elongate medium 116 is deployed from the outlet 118 as the apparatus 110 traverses the wellbore 160. As such, the volume of elongate medium 116 occupying the cavity 111 is reduced. However, as shown in FIG. 4*b*, the isolating fluid 141 remains substantially in its initial configuration. At this stage, the apparatus 110 has not yet entered the liquid portion 147 of the wellbore 160, and as such, no bore fluid 142 has entered the cavity 111 to drive the isolating fluid 141 towards the outlet 118. Hence, this allows for the elongate medium 116 within the cavity 111 to be substantially surrounded by gas 146, rather than isolating fluid 141, during the increased rate of deployment and unspooling of the elongate medium 116. Such an arrangement may reduce the likelihood of adverse interactions of the unspooling elongate medium in a liquid isolating medium. This may provide for a smooth, reliable deployment of the elongate medium without the risk of damage to the structural integrity of the apparatus 110.

FIG. 4*c* illustrates the apparatus 110 at a second stage of deployment. At this stage, the apparatus 110 has traversed further into the wellbore 160 and is below the interface 148, submerged in the liquid portion 147 of the wellbore 160. As shown in FIG. 4*c*, bore fluid 142 from the liquid portion 147 of the wellbore 160 now enters the cavity 111 via the inlet 113, as indicated generally by arrow 119, thus establishing the fluid-fluid interface 143. Furthermore, as bore fluid 142 enters the cavity 111 the isolating fluid 141 moves towards the outlet 118, as indicated generally by arrow 114. This causes the gas 146 within the cavity 111 to be displaced out of the cavity 111 and into the wellbore 160 via outlet 118, as illustrated by the formation of bubbles 158 in the bore fluid 142 of the wellbore 160.

FIG. 4*d* illustrates the apparatus 110 at a third stage of deployment. At this stage, the apparatus 110 has traversed further into the wellbore 160 and all of the elongate medium 116 has been deployed. As shown in FIG. 4*d*, the interface 143 has advanced further within the cavity 111 such that all of the gas 146 has been displaced therefrom. It will be appreciated, however, that the gas 146 will be fully displaced from the cavity 111 shortly after the apparatus 110 enters the liquid portion 147 of the wellbore 160, and thus well before the illustrated third stage of deployment in FIG. 4*d*.

FIGS. 5*a* to 5*d* illustrate an example of the apparatus 10 of FIGS. 1*a* to 1*d* used in connection with a lubricator stack 100. The lubricator stack 100 sits on top of the wellbore 12 and blowout preventer (BOP) 102, and in this example, the bore fluid of the wellbore 12 comprises only a liquid portion 47. The elongate medium 16 extends from the apparatus 10 through the lubricator stack 100 to a surface device 21.

Figures 5A, 5B, 5C, 5D:
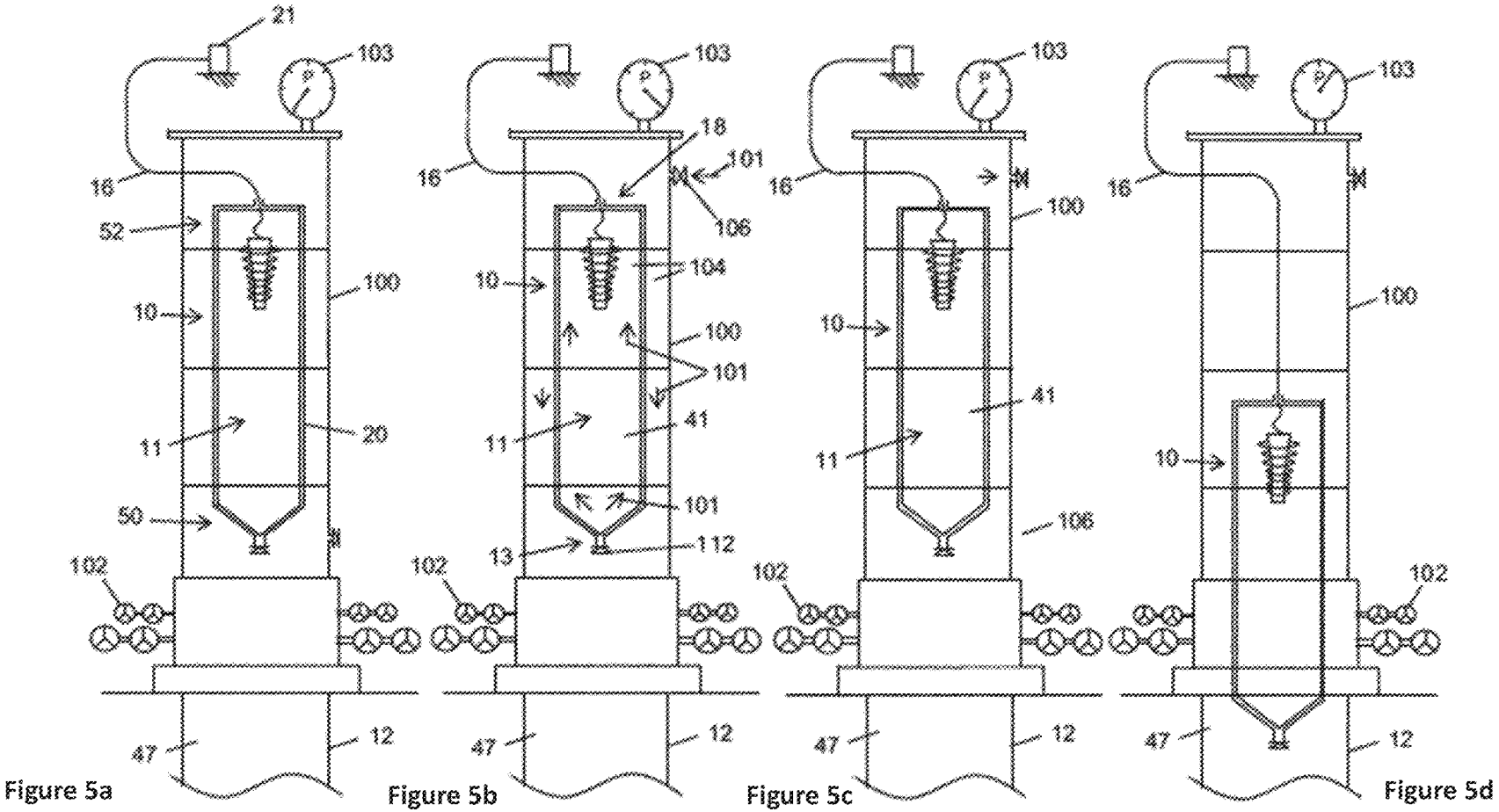
FIGS. 5*a* to 5*d* are diagrammatic illustrations of the apparatus of FIGS. 1*a* to 1*d* inside a lubricator stack prior to deployment.

The apparatus 10 is initially provided in an unfilled condition inside the lubricator stack 100, prior to deployment in the wellbore 12. FIG. 5*b* illustrates the lubricator stack 100 being pressure tested. During the pressure test, the lubricator stack 100 is filled with a pressurised fluid 104, which in this example is achieved by pumping fluid 104 through valve 106. The movement of fluid 104 through the lubricator stack 100 is indicated generally by arrows 101. The inflow of fluid 104 results in an increase in pressure in the lubricator stack 100, as indicated by pressure sensor 103. As the fluid 104 beings to fill the lubricator stack 100, the fluid 104 enters the apparatus 10 via the inlet 13. In this example, the pressurised fluid 104 has been selected so that it may also suitably function as the isolating fluid 41 of the apparatus 10. The inlet 13 of the apparatus 10 is provided with a one-way valve 112, which permits fluid to enter the cavity 11 and prevents fluid from exiting the cavity 11. As such, this provides for the cavity 11 to be filled with isolating fluid 41 through the inlet 13 while also being able to retain the isolating fluid 41 in the cavity 11 thereafter.

Once the pressure test is complete, the fluid 104 is removed from the lubricator stack 100, as shown in FIG. 5*c*. The apparatus 10 however remains completely full of fluid 104 by virtue of the one-way valve 112. As noted, the fluid 104 used in the pressure test has been selected to function also as the isolating fluid 41 of the apparatus 10. Therefore, at this stage, the apparatus 10 is ready for deployment in the wellbore 12. FIG. 5*d* illustrates the lubricator stack 100 open to the wellbore 12, which has resulted in an increase in pressure shown by pressure sensor 103, and as shown, the apparatus 10 now exits the lubricator stack 100 to enter the wellbore 12 and start deployment of the elongate medium 16.

While the example of FIGS. 5*a* to 5*d* show the apparatus being completely filled with isolating fluid prior to deployment, this may not necessarily be the case. For example, the apparatus may be used in connection with a lubricator stack on top of a wellbore comprising a liquid portion as well as a gas portion; for example, much like the wellbore 60 of FIGS. 2*b* to 2*d*. Where the apparatus is used in such a wellbore, it may be required that the apparatus is partially filled with isolating fluid and partially filled with gas prior to deployment.

Figure 6B:
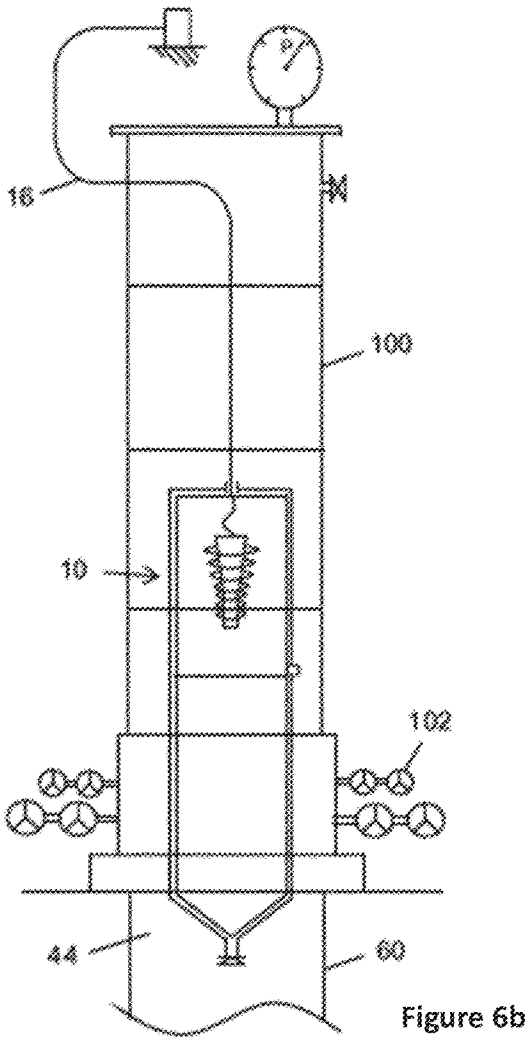
FIGS. 6*a* and 6*b* are diagrammatic illustrations of the apparatus of FIGS. 1*a* to 1*d* inside a lubricator stack prior to deployment.
Figure 6A:
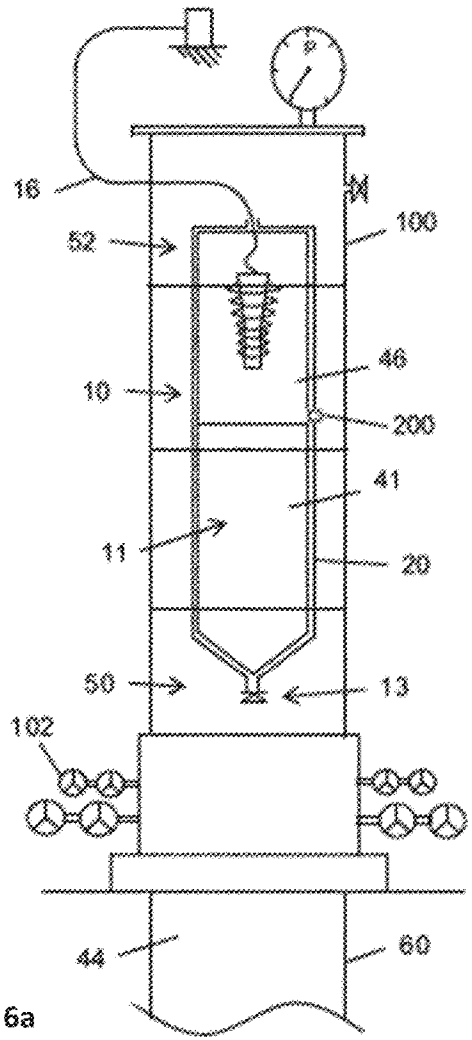

FIG. 6*a* illustrates the apparatus 10 inside the lubricator stack 100 after the pressure test has been completed. In this example, the apparatus 10 comprises a draining mechanism 200. The draining mechanism 200 may be configured to drain partially the isolating fluid 41 from the cavity 11 of the apparatus 10. As such, this may provide for the apparatus 10 to be partially filled with isolating fluid 41 and partially filled with gas 46 prior to deployment, much like the example apparatus of FIGS. 2*a* to 2*d*. This configuration allows for the apparatus 10 to be used in a wellbore comprising a liquid portion and a gas portion, such as a gas cap.

The draining mechanism 200 is provided on a side face of the housing 20 and positioned approximately halfway between the leading end 50 and trailing end 52 of the apparatus 10. In other examples, however, the draining mechanism 200 may be positioned more or less than halfway between the leading end 50 and trailing end 52.

FIG. 6*b* illustrates the apparatus 10 exiting the lubricator stack 100 and entering the gas cap 44 of the wellbore 60.

With reference to FIGS. 7*a*-7*f*, there is shown a winding process which may be used where the elongate medium 16 is wound onto a bobbin 17. Here, the elongate medium is wound in a first axial direction, indicated by arrow 62, relative to a bobbin axis 40 to form a number of adjacent individual turns or wraps, at a steep winding pitch which provides the adjacent wraps in contact with each other (i.e., a closed winding pitch). In the present case the first axial direction is such that the elongate medium 16 is added to the bobbin in an upslope direction of a conical portion 38, starting at point 61 and ending at point 64, thus defining a first wrap layer 66. By winding in an upslope direction each wrap or turn provides support to the subsequent wound wrap or turn of the elongate medium 16.

Figure 7B:
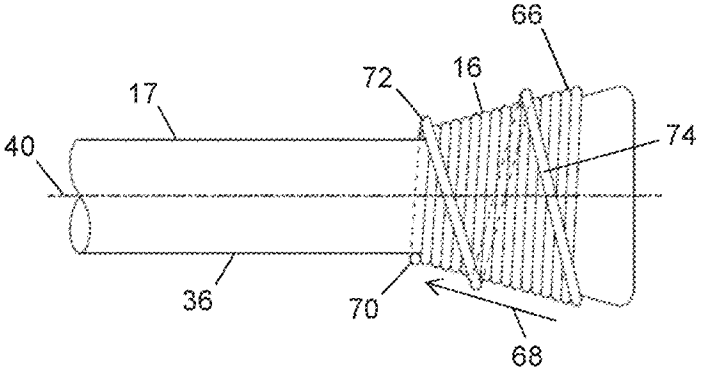
FIGS. 7*a* to 7*f* illustrate a method of winding an elongate medium on a bobbin.

As shown in FIG. 7*b*, the elongate medium is then wound in a reverse second axial direction, illustrated by arrow 68, over the first wrap layer 66 at a much shallower winding pitch, until reaching point 70 where the elongate medium 16 is on the cylindrical portion 36 of the winding surface adjacent the starting point of the first wrap layer 66. This may form a first portion 72 of a second wrap layer 74. Following this, as shown in FIG. 7*c*, winding of the elongate medium 16 is continued further in the second axial direction, illustrated by arrow 76, to form a second portion 78 of the second wrap layer 74, until reaching point 80. The second portion 78 of the second wrap layer 74 is wound at a steeper winding pitch (in this case a closed winding pitch) relative to the first portion 72 of the second wrap layer 74. The second portion 78 may function to provide support to the first wrap layer, and as such in some cases the second portion 78 may be defined as an anchor or anchor winding portion. The first and second wrap layers 66, 74 may form a first wrap segment 82.

Figure 7D:
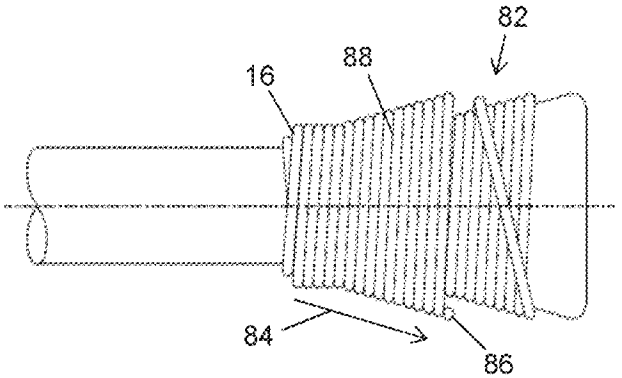
Figure 7A:
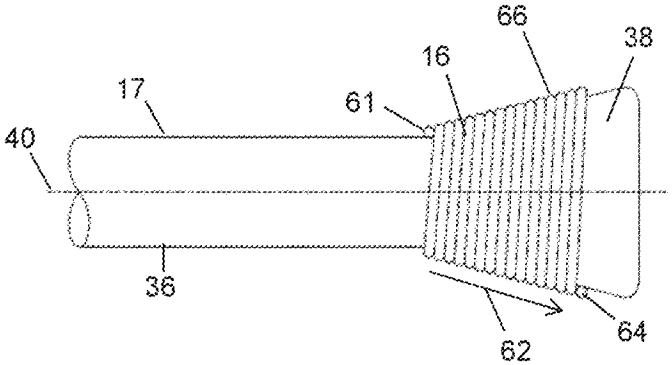
Figure 7C:
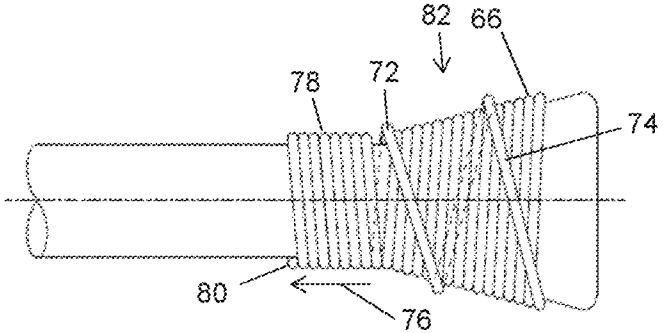
Figure 7E:
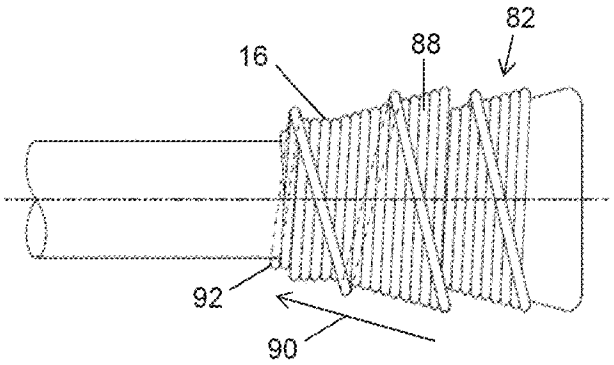
Figure 7F:
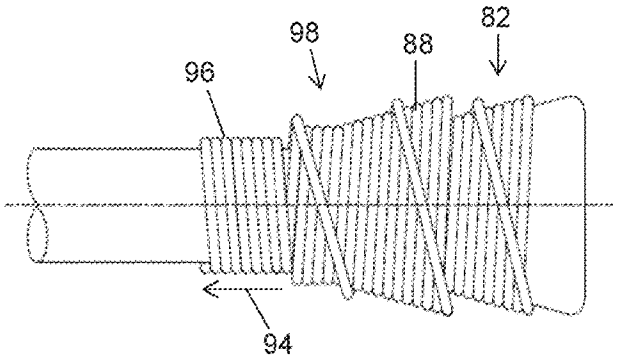

Following this, as illustrated in FIG. 7*d*, the elongate medium 16 is wound again in the first direction, illustrated by arrow 84, over the first wrap segment 82, at a closed wind pitch until reaching point 86 to form a subsequent first layer 88. Next, as illustrated in FIG. 7*e*, the elongate medium 16 is wound in the direction of arrow 90, at a shallower winding pitch over the first layer 88 until reaching point 92, with the elongate medium 16 continuing to be wound in the direction of arrow 94 in FIG. 7*f* to complete a second wrap layer 96. The newly formed first and second wrap layers 88, 96 define a second wrap segment 98 which axially overlaps the first wrap segment 88, wherein each wrap segment extends to a common outer diameter.

The winding process may be continued in the same manner to add further axially overlapping wrap segments each with first and second wrap layers, distributed along the length of the bobbin 17. The winding process may be continued until the required length of elongate medium 16 has been wound onto the bobbin 17 to form a complete spool. In some examples between 10 to 10,000 meters, and possibly more, of elongate medium may be wound onto the bobbin 17, perhaps over 2 to 300, and possibly more, axially overlapping wrap segments.

The provision of partially overlapping wrap segments may be such that at least a proportion of one wrap segment is supported or constrained by the overlapping adjacent segment. Further, the multiple adjacent and overlapping segments may provide a degree of resistance to being disturbed by any object, such as the unspooled portion of the fibre, dragging thereacross. Also, the supporting effect of the overlapping segments may be such that any requirement for end flanges may be minimised or eliminated.

Figure 8C:
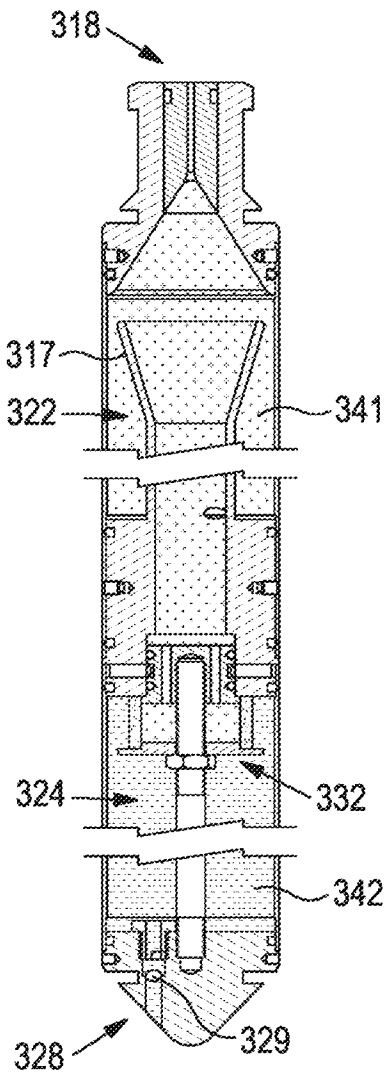
FIGS. 8*a* to 8*c* are diagrammatic illustrations of a further alternative apparatus according to the present disclosure.
Figure 8B:
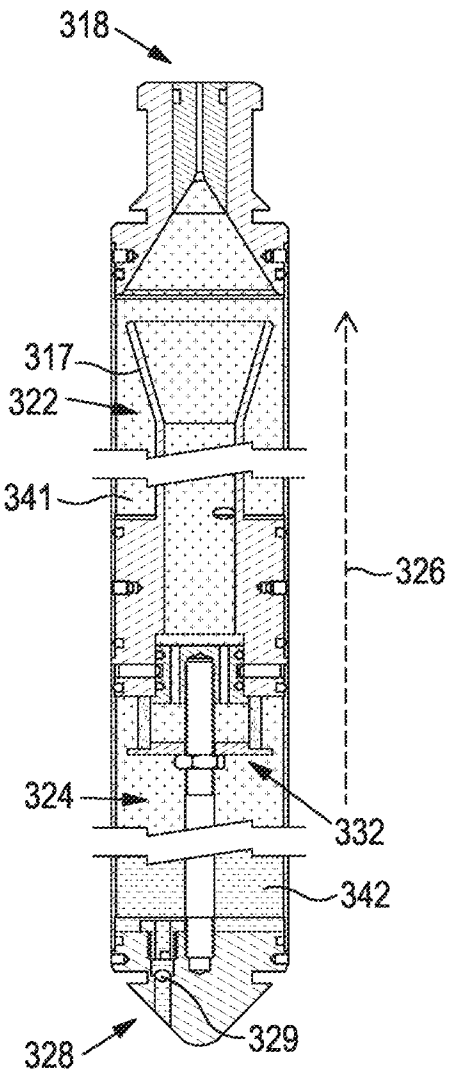
Figure 8A:
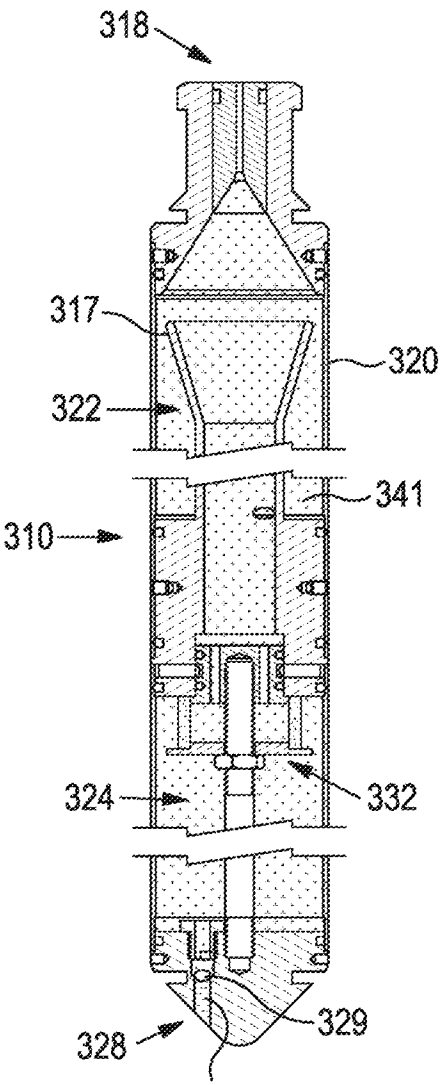

FIGS. 8*a* to 8*c* illustrates a further alternative apparatus 310 in accordance with the present disclosure. The apparatus 310 may comprise a housing 320 having a first chamber 322 and a second chamber 324. In this particular example, the first and second chambers 322, 324 are in fluid communication with a filter 332 provided in the flow path 326. Where the filter 332 is provided, the filter acts as an additional means to prevent debris from bore fluid 342 entering the first chamber 322.

The elongate medium, which in this example is optical fibre, is mounted within the first chamber 322. The elongate medium is wound round bobbin 317 which is then subsequently mounted into the first chamber 322, although one will appreciate that the bobbin 317 is not necessarily required for the elongate medium to be mounted in the first chamber 322. For clarity, the elongate medium is not shown in FIGS. 8*a* to 8*c*.

In use, the apparatus 310 is filled with isolating fluid 341 such that the isolating fluid 341 occupies the free volume in both the first and second chambers 322, 324, as shown in FIG. 8*a*. One method of filling the apparatus 310 with isolating fluid 341 is to submerge the apparatus 310 in a volume of isolating fluid 341 such that the isolating fluid 341 enters via fluid inlet 328, whilst any gas or fluid initially present inside the chambers 322, 324, for example air, is expelled via outlet 318. The apparatus may be submerged in a tank containing the volume of isolating fluid. The isolating fluid 341 may be immiscible with the bore fluid 342. In this example, the isolating fluid 341 may be at least one of the following: a water-based fluid, an oil-based fluid, a mixture of water-based and oil-based fluid. The isolating fluid may be water, or cesium formate, or a mixture thereof.

Filling the apparatus 310 with isolating fluid 341 may occur at the deployment site, for example at the surface of a wellbore. Alternatively, the apparatus may be delivered to the deployment site pre-filled with isolating fluid.

The apparatus 310 is then deployed into the wellbore and the elongate medium deployed into a second configuration. The second configuration may be such that the elongate medium provides one or more coiled portions in the wellbore. A coiled portion need not be helically wound, per se, but rather any bundle of elongate medium that could otherwise serve to provide increased resistance/sensitivity compared to other portions of the elongate medium.

A first end of the elongate medium may be anchored to a surface, for example to a surface module such that the elongate medium is deployed as the apparatus traverses the wellbore. The apparatus 10 may be deployed via gravity, however, it should be understood that other methods of deployment may be employed such as, for example, via fluid pumping or a combination thereof. Fluid pumping may be employed, for example, in deviated or horizontal wellbores. Of course, in some examples, a tractor may be used in order to assist with deployment of the elongate medium in the wellbore. As the apparatus 10 is being deployed into the wellbore, the elongate medium is also deployed. Where the elongate medium is optical fibre, using well-known optical range finding methods, an instantaneous depth and/or speed of the apparatus may be calculated and displayed in real time at the surface.

Various materials and or techniques may be used to control deployment or unintentional unwinding of the elongate medium. For example, a wax, varnish, lacquer, grease or any other material with semi-sticky properties may be applied on the loaded elongate medium to keep the elongate medium from deploying unintentionally. In addition, for example, a friction device may be operably connected close to the launch point of the elongate medium to provide a friction force to prevent unintentional unwinding of the elongate medium.

In this example, as the elongate medium is deployed from outlet 318, isolating fluid 341 is also pulled out of the first chamber 322 into the wellbore from the outlet 318, for example via the boundary layer effect. As this occurs, the pressure inside the first chamber 322 is reduced due to an increase in free volume from both the deployment of the elongate medium 316 and the loss of isolating fluid 341. Isolating fluid 341 within the second chamber 324 will travel into the first chamber 322 via the flow path 326 to compensate for this pressure change in the first chamber 322. The outlet 318 is arranged such that there is no flow of bore fluid into the first chamber 322 via the outlet 318, for example a one-way valve may be provided.

The fluid inlet 328 provided in the housing allows fluid 342 from the wellbore to enter the second chamber as the apparatus 310 traverses a wellbore and the elongate medium 316 is deployed. Thus, the fluid inlet 328 acts as a pressure compensator. A one-way valve 329, for example a ball check valve may be provided at the inlet 328 to prevent isolating fluid 341 and bore fluid 342 from exiting via inlet 328. The in-flow of bore fluid 342 into the second chamber 324 as the elongate member is deployed assists in ensuring that isolating fluid 341 from the second chamber 324 flows into the first chamber 322 to compensate for volume changes in the first chamber 322.

In this example, the apparatus 310 is provided with a fluid inlet 328 and an outlet 318, wherein the outlet 318 is for both fluid and the elongate medium. The inlet 328 is positioned to allow the flow of bore fluid 342 into the second chamber 324. The outlet 318 is arranged to allow flow of isolating fluid 341 from the first chamber 322. As the apparatus 310 traverses the wellbore, bore fluid 342 enters the second chamber 324 via the fluid inlet 328. The isolating fluid 341 present in the second chamber 324 is driven from the second chamber 324 into the first chamber 322 via flow path 326. Isolating fluid 341 within the first chamber 322 exits the first chamber out into the wellbore via the outlet 318. The inlet 328 and outlet 318 are therefore arranged such that the flow path 326 through the apparatus 310 is from the second chamber 324 to the first chamber 322, and not vice versa.

In some examples, an additional outlet for fluid may be provided in addition to the outlet for the elongate medium. The additional fluid outlet where provided may comprise a one-way valve to prevent the flow of wellbore fluid directly into the first chamber 22 as the apparatus traverses the wellbore.

Accordingly, as the apparatus 310 traverses the wellbore and the elongate medium is deployed, the first chamber 322 remains filled with isolating fluid 341. As noted above, the filter 332 may be provided such that in the event bore fluid 342 does enter the first chamber 322, debris from the bore fluid 342 will be removed prior to the bore fluid 342 entering the first chamber 322. The elongate medium within the first chamber 322 is therefore protected from damaging exposure to bore fluid 342.

Where filter 332 is provided, the filter 332 may comprise a substantially cylindrical shape. The flow path through the filter 332 may also be cylindrical. Accordingly, the pressure drop across the filter 332 may be minimised, thus reducing the resistance to fluid flow from the second chamber 324 into the first chamber 322 as the apparatus 310 traverses the wellbore.

The volume of the second chamber 324 may be selected to be at least the same as or greater than the free volume of the first chamber 322 when the elongate medium is fully deployed to ensure that the second chamber 324 contains an adequate volume of isolating fluid 341 for the full deployment process.

The skilled person will appreciate that the alternative apparatus 310 of FIGS. 8*a* to 8*c* may also be used in a wellbore comprising a gas portion and a fluid portion, much like the wellbore 60 of FIGS. 2*a* to 2*d*. In this instance, prior to deployment, the first chamber 322 may be partially filled with isolating fluid 341 and partially with gas, and the second chamber 324 may be completely filled with isolating fluid 341. Alternatively, the first chamber 322 may be completely filled with gas and only the second chamber may be filled with isolating fluid 341. When used in such a wellbore, the apparatus 10 may function largely in the same way as the apparatus 10 of FIGS. 2*a* to 2*d*. For example, the ingress of bore fluid 342 into the cavity 311 via fluid inlet 328 may result in the isolating fluid 341 moving into the first chamber 322 and towards the outlet 318. This may provide for pressure to be balanced throughout the apparatus 310 as the elongate medium is deployed.

The elongate medium may be retrieved back to the surface after use. Alternatively, if a disposable elongate medium is used, the elongate medium may be released and allowed to remain in the wellbore. Such fibres that are configured to remain in the well may have applicability in relation to distributed sensing. In some embodiments, the elongate medium may degrade over time. However, such degradation may only occur after a time that the elongate medium has been used to perform sensing. It may be that is some cases, the deployed elongate medium (and any associated tools or other components) is only expected to be operable for a day or less, such as 12 hours, or less, or even 6 hours or less. In other words, the apparatus 10 may be constructed in such a manner that the survivability of the elongate medium, apparatus 10, etc. beyond a relatively short period is not expected. In such a way, the apparatus 10 can be constructed at reduced cost compared to a permanent installation.

The skilled person will realise that the above-described and illustrated examples are merely exemplary of the implementations of the present disclosure and that various improvements and modifications may be made thereto, without departing from the scope of the invention.

Furthermore, it should be understood that any features described in relation to one example, aspect or embodiment may also be used in relation to any other example, aspect or embodiment.

The invention claimed is:

1. An apparatus for deploying an elongate medium in a bore, comprising:

a housing defining an internal spool cavity and configured to be deployed in the bore; and a spool of elongate medium mounted within the spool cavity;

wherein the housing defines an outlet to permit the elongate medium to be deployed from the spool cavity, and an inlet to permit bore fluid to enter the housing during deployment of the elongate medium from the spool cavity; and wherein, in use, the housing comprises an isolating fluid to isolate the elongate medium from the bore fluid entering the housing, wherein the inlet is positioned to permit bore fluid to enter into the housing relative to the spool cavity such that, in use, an interface is established between the isolating fluid and bore fluid entering the spool cavity, the interface advancing along the spool cavity as the elongate medium is deployed, wherein the spool of elongate medium is provided to be maintained in a non-contact relationship with the advancing interface, and wherein the spool of elongate medium is configured to be deployed such that the volume of the cavity occupied by the spool of elongate medium decreases from one end of the spool cavity to the other to maintain the spool of elongate medium in the non-contact relationship with the advancing interface.

2. The apparatus of claim 1, configured such that the spool of elongate medium remains isolated from bore fluid which has entered the cavity during complete deployment of the elongate medium from the spool cavity.

3. The apparatus of claim 1, wherein the internal spool cavity defines a vacant space not occupied by the spool of elongate medium, wherein, in use, the vacant space is at least partially filled with the isolating fluid, and wherein the vacant space is dimensioned such that during deployment of the elongate medium, the elongate medium remains isolated from bore fluid which has entered the cavity.

4. The apparatus of claim 3, wherein the spool of elongate medium is configured such that the rate of deployment of the elongate medium provides a volumetric increase of the vacant space equal to the rate of intake of bore fluid.

5. The apparatus of claim 3, wherein the vacant space defined by the internal spool cavity is, in use, partially filled with isolating fluid and partially filled with a gas.

6. The apparatus of claim 1, wherein the housing is configured to prevent bore fluid from entering the internal spool cavity above a flow rate determined in accordance with a rate of deployment of the elongate medium.

7. The apparatus of claim 1, wherein the internal spool cavity comprises a first chamber and a second chamber, the spool of elongate medium being mounted within the first chamber, and wherein the first and second chambers are configured to be in fluid communication to permit, in use, isolating fluid provided in the second chamber to be received within the first chamber to fill the volume within the first chamber which has been vacated by the deployed elongate medium.

8. The apparatus of claim 7, wherein the volume of the second chamber is at least equal to the volume vacated by the elongate medium in the first chamber when the elongate medium is fully deployed.

9. The apparatus of claim 7, wherein the internal spool cavity is provided with a partition between the first and second chambers, configured to provide a flow path from the second chamber to the first chamber.

10. The apparatus of claim 7, comprising a filter provided between the first chamber and the second chamber.

11. The apparatus of claim 1, wherein the outlet is provided with a one-way valve permitting a flow path from the spool cavity to the bore or wherein the inlet is provided with a one-way valve permitting a flow path from the bore into the housing.

12. A method for deploying an elongate medium in a bore, comprising:

deploying an apparatus comprising a housing defining an internal spool cavity and a spool of elongate medium mounted within the internal spool cavity, and wherein the housing comprises an isolating fluid, in a bore;

deploying an elongate medium from an outlet of the housing; and receiving bore fluid via an inlet of the housing, as the elongate medium is deployed through the outlet, wherein an interface is defined between the isolating fluid and the bore fluid entering the spool cavity;

maintaining the spool of elongate medium in a non-contact relationship with the interface during deployment of the elongate medium; and deploying the elongate medium such that the volume occupied by the spool of elongate medium decreases from one end of the spool cavity to the other to maintain the spool of elongate medium in the non-contact relationship with the interface.

13. The method of claim 12, wherein the volume of bore fluid received corresponds to the volume vacated by the deployed elongate medium.

14. The method of claim 12, comprising isolating the spool of elongate medium from the bore fluid entering the cavity during the complete deployment of the elongate medium.

15. The method of claim 12, wherein the internal spool cavity comprises a first chamber and a second chamber, the spool of elongate medium being mounted within the first chamber, and wherein the first and second chambers are configured to be in fluid communication, the method comprising: permitting isolating fluid provided in the second chamber to be received within the first chamber to fill the volume within the first chamber which has been vacated by the deployed elongate medium.

16. A kit for deploying an elongate medium in a bore, the kit comprising:

an apparatus configured to be deployable in a bore, the apparatus comprising a housing defining an internal spool cavity, an outlet and an inlet; and a spool of elongate medium mounted within the spool cavity, and a fluid tank, wherein the fluid tank is configured to contain a volume of an isolating fluid, wherein the inlet is positioned to permit bore fluid to enter into the housing relative to the spool cavity such that, in use, an interface is established between the isolating fluid and bore fluid entering the spool cavity, the interface advancing along the spool cavity as the elongate medium is deployed, wherein the spool of elongate medium is provided to be maintained in a non-contact relationship with the advancing interface, and wherein the spool of elongate medium is configured to be deployed such that the volume of the cavity occupied by the spool of elongate medium decreases from one end of the spool cavity to the other to maintain the spool of elongate medium in the non-contact relationship with the advancing interface.

* * * * *